US010794620B2

(12) United States Patent
Mizutani

(10) Patent No.: US 10,794,620 B2
(45) Date of Patent: Oct. 6, 2020

(54) AIR-CONDITIONING APPARATUS

(71) Applicant: Mitsubishi Electric Corporation, Tokyo (JP)

(72) Inventor: Shuhei Mizutani, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/313,941

(22) PCT Filed: Sep. 12, 2016

(86) PCT No.: PCT/JP2016/076785
§ 371 (c)(1),
(2) Date: Dec. 28, 2018

(87) PCT Pub. No.: WO2018/047331
PCT Pub. Date: Mar. 15, 2018

(65) Prior Publication Data

US 2019/0383532 A1 Dec. 19, 2019

(51) Int. Cl.
*F25B 13/00* (2006.01)
*F25B 41/00* (2006.01)
(Continued)

(52) U.S. Cl.
CPC ..... *F25B 41/003* (2013.01); *F25B 5/00* (2013.01); *F25B 5/02* (2013.01); *F25B 6/00* (2013.01);
(Continued)

(58) Field of Classification Search
CPC .... F25B 13/00; F25B 6/00; F25B 6/02; F25B 6/04; F25B 5/00; F25B 5/02; F25B 5/04;
(Continued)

(56) References Cited

U.S. PATENT DOCUMENTS 4,693,089 A * 9/1987 Bourne ..... F24D 3/08 62/79
5,758,514 A 6/1998 Genung et al.
(Continued)

FOREIGN PATENT DOCUMENTS

JP 2003-121019 A 4/2003
JP 2012-107857 A 6/2012
WO 2012/147336 A1 11/2012

OTHER PUBLICATIONS

International Search Report of the International Searching Authority dated Nov. 29, 2016 for the corresponding International application No. PCT/JP2016/076785 (and English translation).

*Primary Examiner* — David J Teitelbaum
(74) *Attorney, Agent, or Firm* — Posz Law Group, PLC

(57) ABSTRACT

An air-conditioning apparatus reduces occurrence of refrigerant accumulation on a downstream side of an evaporator to favorably circulate refrigerant. The air-conditioning apparatus includes: a main circuit in which a compressor, a refrigerant-flow switching device, a load-side heat exchanger, a load-side expansion device and three heat-source-side heat exchangers are connected by pipes to circulate refrigerant; and a heat-exchanger flow-passage switching device which performs switching to apply a first series refrigerant passage in the case where the three heat-source-side heat exchangers are used as condensers, and switching to apply a parallel refrigerant passage in the case where the three heat-source-side heat exchangers are used as evaporators. In the first series refrigerant passage, on an upstream side, the first and second heat-source-side heat exchangers are connected parallel to each other, and on a downstream side, the third heat-source-side heat exchanger is located. In the parallel refrigerant passage, first to third heat-source-side heat exchanger are connected parallel to each other.

14 Claims, 5 Drawing Sheets

(51) Int. Cl.

| | |
|---|---|
| ***F25B 5/02*** | (2006.01) |
| ***F25B 6/04*** | (2006.01) |
| ***F25B 5/00*** | (2006.01) |
| ***F25B 6/02*** | (2006.01) |
| ***F25B 6/00*** | (2006.01) |

(52) U.S. Cl.
CPC ..... *F25B 6/02* (2013.01); *F25B 6/04* (2013.01); *F25B 13/00* (2013.01); *F25B 2313/0292* (2013.01); *F25B 2313/02742* (2013.01)

(58) Field of Classification Search
CPC ..... F25B 41/003; F25B 2313/0292; F25B 2313/02742
See application file for complete search history.

(56) References Cited

U.S. PATENT DOCUMENTS

| | | | | |
|---|---|---|---|---|
| 9,068,766 | B2 * | 6/2015 | Tamaki | F24D 17/02 |
| 9,228,765 | B2 * | 1/2016 | Oya | F25B 41/043 |
| 2012/0118533 | A1 | 5/2012 | Jang et al. | |
| 2014/0260392 | A1 * | 9/2014 | Hawkins | F25B 5/04 62/238.6 |
| 2015/0292756 | A1 * | 10/2015 | Takenaka | F25B 41/003 62/160 |

* cited by examiner

AIR-CONDITIONING APPARATUS

CROSS REFERENCE TO RELATED APPLICATION

This application is a U.S. national stage application of PCT/JP2016/076785 filed on Sep. 12, 2016, the contents of which are incorporated herein by reference.

TECHNICAL FIELD

The present invention relates to an air-conditioning apparatus in which in the case where at least two of three heat-source-side heat exchangers are used as condensers, they may be connected in series to each other to allow refrigerant to flow therethrough, and in the case where the three heat-source-side heat exchangers are used as evaporators, they may be connected parallel to each other to allow the refrigerant to flow therethrough.

BACKGROUND ART

In conventional air-conditioning apparatuses such as multi-air-conditioning apparatuses for a building, in a refrigerant circuit, an outdoor unit installed outside the building and functioning as a heat source unit is connected to an indoor unit installed in the building by pipes. In the refrigerant circuit, refrigerant is circulated to heat or cool indoor air with heat transferred from or received by the refrigerant, as a result of which a target space to be air-conditioned is heated or cooled.

In a heating operation, in the case where a plurality of heat exchangers connected in parallel are used as evaporators as in outdoor heat exchangers, refrigerant flows through the heat exchangers connected in parallel. It is therefore possible to reduce the pressure loss at the evaporators, thus improving the performance of the evaporators and the heating capacity.

However, in a cooling operation, in the case where the heat exchangers connected in parallel are used as condensers, the refrigerant flows through the heat exchangers connected parallel to each other, and as a result, the flow velocity of refrigerant flowing through heat transfer pipes drops. Consequently, an in-pipe heat transfer coefficient is reduced, thus deteriorating the performance of the condensers and a cooling capacity.

In view of the above, in order that the performance of the heat exchangers be improved as either condensers or evaporators, whichever function, according to a technique, a flow passage to be used is switched with a plurality of flow switching valves. In this technique, in the case where the heat exchangers are used as condensers, the flow passage is switched to a flow passage in which the heat exchangers are connected in series, thereby allowing refrigerant to flow through the heat exchangers connected in series. Consequently, the flow velocity of the refrigerant is increased, thereby improving the performance of the condensers. On the other hand, in the case where the plurality of heat exchangers are used as evaporators, the flow passage is switched to a flow passage in which the heat exchangers are connected in parallel, thereby allowing the refrigerant to flow through the heat exchangers connected in parallel. Consequently, the pressure loss is reduced, thereby improving the performance of the evaporators. Such a method of improving the performance in the cooling operation and the heating operation has been proposed (see Patent Literature 1, for example).

CITATION LIST

Patent Literature

Patent Literature 1: Japanese Unexamined Patent Application Publication No. 2003-121019

SUMMARY OF INVENTION

Technical Problem

In an air-conditioning apparatus described in Patent Literature 1, in the case where a plurality of refrigerant flow switching valves are switched to cause an outdoor heat exchanger unit to function as a condenser in a cooling operation, a plurality of heat exchangers forming the outdoor heat exchanger unit are connected in series to allow refrigerant to flow therethrough. Thereby, the flow velocity of the refrigerant is increased, thus improving the performance of the condenser.

By contrast, in the case where the refrigerant flow switching valves are switched to cause the outdoor heat exchanger unit to function as an evaporator in the heating operation, the heat exchangers forming the outdoor heat exchanger unit are connected in parallel to allow the refrigerant to flow therethrough. Thereby, the pressure loss at the evaporator is reduced, thus improving the performance of the evaporator.

However, in the case where the heat exchangers are simply connected in series, if the flow velocity of the refrigerant is slow, the volume of part of the evaporator which is located on the downstream side is too large, thus causing liquid refrigerant to stay in the part of the evaporator which is located on the downstream side. That is, circulation of the refrigerant is worsened.

The present invention has been made to solve the above problems, and an object of the invention is to provide an air-conditioning apparatus which reduces occurrence of refrigerant accumulation on the downstream side of the evaporator, and causes refrigerant to be circulated satisfactorily.

Solution to Problem

An air-conditioning apparatus according to an embodiment of the present invention includes a main circuit in which a compressor, a refrigerant-flow switching device, a load-side heat exchanger, a load-side expansion device and at least three heat-source-side heat exchangers are connected by pipes to circulate refrigerant. The at least three heat-source-side heat exchangers include a first heat-source-side heat exchanger, a second heat-source-side heat exchanger and a third heat-source-side heat exchanger. The air-conditioning apparatus includes a heat-exchanger flow-passage switching device which switches a refrigerant passage to be used, to a first series refrigerant passage in the case where the at least three heat-source-side heat exchangers are used as condensers, and switches the refrigerant passage to be used, to a parallel refrigerant passage in the case where the at least three heat-source-side heat exchangers are used as evaporators. In the case where the at least three heat-source-side heat exchangers are used as the condensers, the first series refrigerant passage is applied, and in the first series refrigerant passage, on an upstream side, the first heat-source-side heat exchanger and the second heat-source-side heat exchanger are connected in parallel to each other, and on a downstream side, the third heat-source-side heat exchanger is connected in series to the first heat-source-side heat exchanger and the second heat-source-side heat exchanger. In the case where the at least three heat-source-side heat exchangers are used as the evaporators, the parallel refrigerant passage is applied, and in the parallel refrigerant passage, the first heat-source-side heat exchanger, the second heat-source-side heat exchanger and the third heat-source-side heat exchanger are connected parallel to each other.

Advantageous Effects of Invention

The air-conditioning apparatus according to an embodiment of the present invention includes a heat-exchanger flow-passage switching device which switches a refrigerant passage to be used, to a first series refrigerant passage in the case where at least three heat-source-side heat exchangers are used as condensers, and switches the refrigerant passage to be used, to a parallel refrigerant passage in the case where the at least three heat-source-side heat exchangers are used as evaporators. Therefore, between a cooling operation and a heating operation, it is possible to switch the refrigerant passage of the at least three heat-source-side heat exchangers between the series refrigerant passage and the parallel refrigerant passage. Furthermore, in the case where the at least three heat-source-side heat exchangers are used as the condensers, in the first series refrigerant passage, on the upstream side, the first heat-source-side heat exchanger and the second heat-source-side heat exchanger are connected parallel to each other, and on the downstream side, the third heat-source-side heat exchanger is connected in series to the first heat-source-side heat exchanger and the second heat-source-side heat exchanger. Therefore, in the first series refrigerant passage, only the third heat-source-side heat exchanger is provided on the downstream side of the evaporator, and the capacity on the downstream side of the evaporator is small. Thus, even if the flow velocity of the refrigerant is reduced, it is possible to reduce occurrence of refrigerant accumulation in which liquid refrigerant accumulates on the downstream side of the evaporator, and thus to favorably circulate the refrigerant.

DESCRIPTION OF EMBODIMENTS

Figure 1:
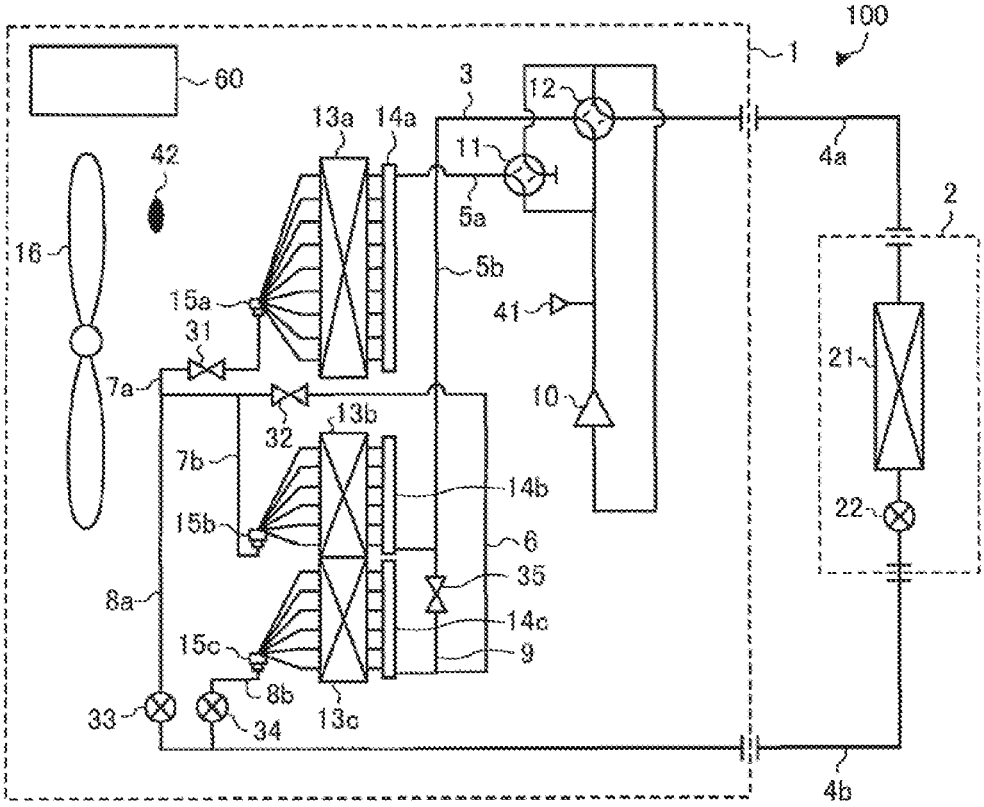
FIG. 1 is a schematic circuit configuration diagram illustrating an example of the circuit configuration of an air-conditioning apparatus according to embodiment 1 of the present invention.

Embodiment 1 of the present invention will be described with reference to the drawings.

In the drawings, structural elements denoted by the same reference sign are the same as each other. The same is true of the entire text of the specification.

Also, the configurations of structural elements which are described in the text of the specification are merely examples. That is, the actual configurations of structural elements are not limited to the above ones.

Embodiment 1

FIG. 1 is a schematic circuit configuration diagram illustrating an example of the circuit configuration of an air-conditioning apparatus 100 according to embodiment 1 of the present invention.

In the air-conditioning apparatus 100 as illustrated in FIG. 1, an outdoor unit 1 and an indoor unit 2 are connected by a first main pipe 4*a* and a second main pipe 4*b*.

FIG. 1 illustrates, as an example, the case where a single indoor unit 2 is connected to the outdoor unit 1 by the first main pipe 4*a* and the second main pipe 4*b*. However, the number of indoor units 2 connected to the outdoor unit 1 is not limited to one, and a plurality of indoor units 2 may be connected to the outdoor unit 1.

[Outdoor Unit 1]

The outdoor unit 1 includes, as structural elements of a main circuit, a compressor 10, a first four-way valve 11, a second four-way valve 12, a first heat-source-side heat exchanger 13*a*, a second heat-source-side heat exchanger 13*b* and a third heat-source-side heat exchanger 13*c*.

The first four-way valve 11 and the second four-way valve 12 each correspond to a refrigerant-flow switching device.

In the main circuit, the compressor 10, the first four-way valve 11, the second four-way valve 12, a load-side heat exchanger 21, a load-side expansion device 22, the first heat-source-side heat exchanger 13*a*, the second heat-source-side heat exchanger 13*b* and the third heat-source-side heat exchanger 13*c* are sequentially connected by refrigerant pipes 3 to circulate refrigerant.

The "refrigerant pipe 3" is a general term for pipes through which refrigerant for use in the air-conditioning apparatus 100 flows. The refrigerant pipes 3 include, for example, the first main pipe 4*a*, the second main pipe 4*b*, a first primary pipe 5*a*, a second primary pipe 5*b*, a series pipe 6, a first inlet and outlet pipe 7*a*, a second inlet and outlet pipe 7*b*, a first parallel pipe 8*a*, a second parallel pipe 8*b*, a third parallel pipe 9, a first header 14*a*, a second header 14*b*, a third header 14*c*, a first distributor 15*a*, a second distributor 15*b*, and a third distributor 15*c*.

Furthermore, the outdoor unit 1 may include another heat-source-side heat exchanger or other heat-source-side heat exchangers in addition to the first heat-source-side heat exchanger 13*a*, the second heat-source-side heat exchanger 13*b* and the third heat-source-side heat exchanger 13*c*.

The first main pipe 4*a* and the second main pipe 4*b* connect the outdoor unit 1 and the indoor unit 2. The first primary pipe 5*a* connects the first four-way valve 11 and the first header 14*a*. The second primary pipe 5*b* connects the second four-way valve 12 and the second header 14*b*. The series pipe 6 connects the first heat-source-side heat exchanger 13*a*, the second heat-source-side heat exchanger 13*b*, and the third heat-source-side heat exchanger 13*c* in series via the first distributor 15*a* and the first inlet and outlet pipe 7*a*, via the second distributor 15*b* and the second inlet and outlet pipe 7*b*, and via the third header 14*c*, respectively. That is, the series pipe 6 connects the first inlet and outlet pipe 7*a* and the third header 14*c*. To an intermediate part of the series pipe 6, the second inlet and outlet pipe 7*b* is connected. The first parallel pipe 8*a* connects a connection part at which the first inlet and outlet pipe 7*a* and the series pipe 6 are connected to each other and the second main pipe 4*b* extending to the load-side expansion device 22. The second parallel pipe 8*b* is connected to part of the second main pipe 4*b* extending to the load-side expansion device 22, that is closer to the third heat-source-side heat exchanger 13*c*. That is, the second parallel pipe 8*b* connects the third distributor 15*c* and the second main pipe 4*b*. The third parallel pipe 9 connects the second four-way valve 12 and the third heat-source-side heat exchanger 13*c* via the second primary pipe 5*b* and via the series pipe 6 and the third header 14*c*, respectively. That is, the third parallel pipe 9 connects an intermediate part of the second primary pipe 5*b* and an intermediate part of the series pipe 6.

The outdoor unit 1 includes, as a heat-exchanger flow-passage switching device, a first opening and closing device 31, a second opening and closing device 32, a third opening and closing device 33, a fourth opening and closing device 34 and a fifth opening and closing device 35.

Furthermore, the outdoor unit 1 is provided with a fan 16 serving as an air-sending device. The fan 16 adopts, for example, a top flow system in which the fan 16 is located above the first heat-source-side heat exchanger 13*a*, the second heat-source-side heat exchanger 13*b* and the third heat-source-side heat exchanger 13*c*, or a side flow system in which the fan 16 is located lateral to the first heat-source-side heat exchanger 13*a*, the second heat-source-side heat exchanger 13*b* and the third heat-source-side heat exchanger 13*c*.

The compressor 10 sucks refrigerant, and compresses the refrigerant to cause it to be in a high-temperature and high-pressure state. As the compressor 10, for example, an inverter compressor the capacity of which is controllable is used. To be more specific, for example, a compressor having a low-pressure shell-structure is used as the compressor 10. The compressor having a low-pressure shell structure includes a compression chamber in a sealed container, and sucks low-pressure refrigerant from the sealed container, whose atmosphere is a low refrigerant pressure atmosphere, and compresses the low-pressure refrigerant.

The first four-way valve 11 and the second four-way valve 12 are used to perform switching between a refrigerant passage for a cooling operation mode and a refrigerant passage for a heating operation mode.

In the cooling operation mode, at least one of the first heat-source-side heat exchanger 13*a*, the second heat-source-side heat exchanger 13*b*, and the third heat-source-side heat exchanger 13*c* is use as a condenser or a gas cooler. In embodiment 1, as cooling operation modes, a high-load cooling operation mode, an intermediate-load cooling operation mode and a low-load cooling operation mode are present. In the heating operation, the first heat-source-side heat exchanger 13*a*, the second heat-source-side heat exchanger 13*b*, and the third heat-source-side heat exchanger 13*c* are used as evaporators.

The first four-way valve 11 allows or blocks flowing of the refrigerant discharged from the compressor 10 toward the first heat-source-side heat exchanger 13*a*.

The second four-way valve 12 allows the refrigerant discharged from the compressor 10 to flow to the second heat-source-side heat exchanger 13*b* or the load-side heat exchanger 21.

Each of the first heat-source-side heat exchanger 13*a*, the second heat-source-side heat exchanger 13*b* and the third heat-source-side heat exchanger 13*c* includes a plurality of heat transfer pipes and a plurality of fins as structural elements.

Each of the heat transfer pipes is a flat pipe, and extends in a horizontal direction. The heat transfer pipes define refrigerant passages in the first heat-source-side heat exchanger 13*a*, the second heat-source-side heat exchanger 13*b* and the third heat-source-side heat exchanger 13*c*.

The fins are plate-shaped. The fins are spaced from each other by a predetermined interval. The fins extend in a vertical direction which is a direction perpendicular to an extending direction of the heat transfer pipes, and the heat transfer pipes are provided to extend through the fins.

The first heat-source-side heat exchanger 13*a* is provided independently of and away from the second heat-source-side heat exchanger 13*b* and the third heat-source-side heat exchanger 13*c*. The first heat-source-side heat exchanger 13*a* is located above the second heat-source-side heat exchanger 13*b* in the vertical direction.

The first heat-source-side heat exchanger 13*a* is provided with a single first header 14*a* and a single first distributor 15*a*.

The second heat-source-side heat exchanger 13*b* is located above the third heat-source-side heat exchanger 13*c* in the vertical direction. Part of the second heat-source-side heat exchanger 13*b* is formed integrally with the third heat-source-side heat exchanger 13*c* to share fins as structural elements with the third heat-source-side heat exchanger 13*c*. That is, the heat transfer pipes of part of the second heat-source-side heat exchanger 13*b* and the heat transfer pipes of part of the third heat-source-side heat exchanger 13*c* extend through the same fins.

The remaining part of the second heat-source-side heat exchanger 13*b*, which is other than the above part of the second heat-source-side heat exchanger 13*b*, is formed independently of the third heat-source-side heat exchanger 13*c*. That is, the heat transfer pipes of the remaining part of the second heat-source-side heat exchanger 13*b* and the heat transfer pipes of the remaining part of the third heat-source-side heat exchanger 13*c*, which is other than the above part of the third heat-source-side heat exchanger 13*c*, are made to extend through different fins.

The second heat-source-side heat exchanger 13*b* is provided with a single second header 14*b* and a single second distributor 15*b*.

The third heat-source-side heat exchanger 13*c* is equipped with a single third header 14*c* and a single third distributor 15*c*.

The first heat-source-side heat exchanger 13*a*, the second heat-source-side heat exchanger 13*b* and the third heat-source-side heat exchanger 13*c* function as condensers in the cooling operation mode, and function as evaporators in the heating operation mode. The first heat-source-side heat exchanger 13*a*, the second heat-source-side heat exchanger 13*b* and the third heat-source-side heat exchanger 13*c* cause heat exchange to be performed between air supplied by the fan 16 and the refrigerant flowing through the heat transfer pipes. In the cooling operation mode, all or only one or ones of the first heat-source-side heat exchanger 13*a*, the second heat-source-side heat exchanger 13*b* and the third heat-source-side heat exchanger 13*c* functions or function as condensers or a condenser, in accordance with which of the above cooling operation modes included in the cooling operation mode is selected.

It should be noted that the first heat-source-side heat exchanger 13*a*, the second heat-source-side heat exchanger 13*b* and the third heat-source-side heat exchanger 13*c* are formed such that the sum of a heat transfer area of the first heat-source-side heat exchanger 13*a* and a heat transfer area of the second heat-source-side heat exchanger 13*b* is larger than a heat transfer area of the third heat-source-side heat exchanger 13*c*. Therefore, the heat transfer pipes are provided such that the sum of the number of heat transfer pipes of the first heat-source-side heat exchanger 13*a* and the number of heat transfer pipes of the second heat-source-side heat exchanger 13*b* is larger than the number of heat transfer pipes of the third heat-source-side heat exchanger 13*c*.

The first header 14*a* is provided at part of the refrigerant passage which is located on an inlet side of the first heat-source-side heat exchanger 13*a* in the case where the first heat-source-side heat exchanger 13*a* is used as a condenser.

The first header 14*a* includes a plurality of branch pipes, which are narrow pipes connected to the respective heat transfer pipes of the first heat-source-side heat exchanger 13*a*, and a main pipe connected to the plurality of branch pipes. The main pipe is connected to the first primary pipe 5*a* connected to the first four-way valve 11. Upper part of the main pipe is connected to the first primary pipe 5*a*. In the case where the first heat-source-side heat exchanger 13*a* is used as a condenser, the first header 14*a* allows the refrigerant flowing from the first primary pipe 5*a* into the main pipe to flow into the first heat-source-side heat exchanger 13*a* through the branch pipes. In the case where the first heat-source-side heat exchanger 13*a* is used as an evaporator, in the first header 14*a*, the refrigerant flowing from the first heat-source-side heat exchanger 13*a* flow into the branch pipes, and then flows from the branch pipes into the main pipe to flow into the first primary pipe 5*a*.

The second header 14*b* is provided at part of the refrigerant passage which is located on an inlet side of the second heat-source-side heat exchanger 13*b* in the case where the second heat-source-side heat exchanger 13*b* is used as a condenser.

The second header 14*b* includes a plurality of branch pipes, which are narrow pipes connected to the respective heat transfer pipes of the second heat-source-side heat exchanger 13*b*, and a main pipe connected to the branch pipes. The main pipe is connected to the second primary pipe 5*b* connected to the second four-way valve 12. Lower part of the main pipe is connected to the second primary pipe 5*b*. In the case where the second heat-source-side heat exchanger 13*b* is used as a condenser, the second header 14*b* allows the refrigerant flowing from the second primary pipe 5*b* into the main pipe to flow into the second heat-source-side heat exchanger 13*b* through the branch pipes. In the case where the second heat-source-side heat exchanger 13*b* is used as an evaporator, in the second header 14*b*, the refrigerant flowing from the second heat-source-side heat exchanger 13*b* flows into the branch pipes, and then flows from the branch pipes into the main pipe to flow into the second primary pipe 5*b*.

The third header 14*c* is provided at part of the refrigerant passage which is located on an inlet side of the third heat-source-side heat exchanger 13*c* in the case where the third heat-source-side heat exchanger 13*c* is used as a condenser.

The third header 14*c* includes a plurality of branch pipes, which are narrow pipes connected to the respective heat transfer pipes of the third heat-source-side heat exchanger 13*c*, and a main pipe connected to the plurality of branch pipes. The main pipe is also connected to the series pipe 6. Lower part of the main pipe is connected to the series pipe 6. In the case where the third heat-source-side heat exchanger 13*c* is used as a condenser, the third header 14*c* allows the refrigerant flowing from the series pipe 6 into the main pipe to flow into the third heat-source-side heat exchanger 13*c* through the plurality of branch pipes. In the case where the third heat-source-side heat exchanger 13*c* is used as an evaporator, in the third header 14*c*, the refrigerant flowing from the third heat-source-side heat exchanger 13*c* flows into the branch pipes, and then flows from the branch pipes into the second primary pipe 5*b* through the main pipe to flow into the series pipe 6. Part of the refrigerant flowing from the series pipe 6 flows into the third parallel pipe 9 extending to the second primary pipe 5*b*.

The first distributor 15*a* is provided at the part of the refrigerant passage which is located on an inlet side of the first heat-source-side heat exchanger 13*a* in the case where the first heat-source-side heat exchanger 13*a* is used as an evaporator.

The first distributor 15*a* includes a plurality of narrow pipes connected to the respective heat transfer pipes of the first heat-source-side heat exchanger 13*a* and a main body which is a joining part at which the narrow pipes join each other. The main body is connected to the first inlet and outlet pipe 7*a* connected to the series pipe 6. In the case where the first heat-source-side heat exchanger 13*a* is used as a condenser, the first distributor 15*a* allows the refrigerant flowing from the first heat-source-side heat exchanger 13*a* into the narrow pipes to flow into the first inlet and outlet pipe 7*a* through the main body. In the case where the first heat-source-side heat exchanger 13*a* is used as an evaporator, the first distributor 15*a* allows the refrigerant flowing from the first inlet and outlet pipe 7*a* into the main body to flow into the first heat-source-side heat exchanger 13*a* through the narrow pipes.

The second distributor 15*b* is provided at the part of the refrigerant passage which is located on an inlet side of the second heat-source-side heat exchanger 13*b* in the case where the second heat-source-side heat exchanger 13*b* is used as an evaporator.

The second distributor 15*b* includes a plurality of narrow pipes connected to the respective heat transfer pipes of the second heat-source-side heat exchanger 13*b* and a main body which is a joining part at which the narrow pipes join each other. The main body is connected to the second inlet and outlet pipe 7*b* connected to the series pipe 6. In the case where the second heat-source-side heat exchanger 13*b* is used as a condenser, the second distributor 15*b* allows the refrigerant flowing from the second heat-source-side heat exchanger 13*b* into the narrow pipes to flow into the second inlet and outlet pipe 7*b* through the main body. In the case where the second heat-source-side heat exchanger 13*b* is used as an evaporator, the second distributor 15*b* allows the refrigerant flowing from the second inlet and outlet pipe 7*b* into the main body to flow into the second heat-source-side heat exchanger 13*b* through the plurality of narrow pipes.

The third distributor 15*c* is provided at the part of the refrigerant passage which is located on an inlet side of the third heat-source-side heat exchanger 13*c* in the case where the third heat-source-side heat exchanger 13*c* is used as an evaporator.

The third distributor 15*c* includes a plurality of narrow pipes connected to the respective heat transfer pipes of the third heat-source-side heat exchanger 13*c* and a main body which is a joining part at which the narrow pipes join each other. The main body is connected to the second parallel pipe 8*b* connected to the second main pipe 4*b*. In the case where the third heat-source-side heat exchanger 13*c* is used as a condenser, the third distributor 15*c* allows the refrigerant flowing from the third heat-source-side heat exchanger 13*c* into the narrow pipes to flow into the second parallel pipe 8*b* through the main body. In the case where the third heat-source-side heat exchanger 13*c* is used as an evaporator, the third distributor 15*c* allows the refrigerant flowing from the second parallel pipe 8*b* into the main body to flow into the third heat-source-side heat exchanger 13*c* through the plurality of narrow pipes.

The series pipe 6 connects the third header 14*c* and the first inlet and outlet pipe 7*a* extending to the first distributor 15*a*. In the case where at least one of the first heat-source-side heat exchanger 13*a* and the second heat-source-side heat exchanger 13*b* is used as a condenser, the series pipe 6 allows low-quality, high-pressure refrigerant, which is in the two-phase state or in the liquid state and flows from the first distributor 15*a* and the second distributor 15*b*, to flow into the third heat-source-side heat exchanger 13*c* via the first opening and closing device 31, the second opening and closing device 32 and the third header 14*c*.

The series pipe 6 is provided with the second opening and closing device 32.

The first inlet and outlet pipe 7*a* connects the first distributor 15*a* and the series pipe 6. In the case where the first heat-source-side heat exchanger 13*a*, the second heat-source-side heat exchanger 13*b* and the third heat-source-side heat exchanger 13*c* are used as evaporators, the first inlet and outlet pipe 7*a* allows low-quality, low-pressure refrigerant which is in a two-phase state or in a liquid state to flow into the first heat-source-side heat exchanger 13*a* via the first opening and closing device 31 and the first distributor 15*a*.

The first inlet and outlet pipe 7*a* is provided with the first opening and closing device 31.

The second inlet and outlet pipe 7*b* connects the second distributor 15*b* and the series pipe 6. In the case where the first heat-source-side heat exchanger 13*a*, the second heat-source-side heat exchanger 13*b*, and the third heat-source-side heat exchanger 13*c* are used as evaporators, the second inlet and outlet pipe 7*b* allows the low-quality, low-pressure refrigerant which is in the two-phase state or in the liquid state to flow into the second heat-source-side heat exchanger 13*b* via the second distributor 15*b*.

The first parallel pipe 8*a* connects the second main pipe 4*b* and the connection part at which the first inlet and outlet pipe 7*a* and the series pipe 6 are connected to each other. In the case where the first heat-source-side heat exchanger 13*a*, the second heat-source-side heat exchanger 13*b* and the third heat-source-side heat exchanger 13*c* are used as evaporators, the first parallel pipe 8*a* allows the low-quality, low-pressure refrigerant which is in the two-phase state or in the liquid state to divide into and flow into the first inlet and outlet pipe 7*a* and the series pipe 6 via the third opening and closing device 33.

The first parallel pipe 8*a* is provided with the third opening and closing device 33.

The second parallel pipe 8*b* connects the third distributor 15*c* and the second main pipe 4*b*. In the case where the first heat-source-side heat exchanger 13*a*, the second heat-source-side heat exchanger 13*b* and the third heat-source-side heat exchanger 13*c* are used as evaporators, the second parallel pipe 8*b* allows the low-quality, low-pressure refrigerant being in the two-phase state or in the liquid state to flow into the third heat-source-side heat exchanger 13*c* via the third distributor 15*c*, while causing part of the low-quality, low-pressure refrigerant to flow into the first parallel pipe 8*a* via the fourth opening and closing device 34.

The third parallel pipe 9 connects the second primary pipe 5*b* extending to the second header 14*b* and the series pipe 6 extending to the third header 14*c*. In the case where the first heat-source-side heat exchanger 13*a*, the second heat-source-side heat exchanger 13*b* and the third heat-source-side heat exchanger 13*c* are used as evaporators, the third parallel pipe 9 allows high-quality, low-pressure refrigerant being in the two-phase state or in the gas state and flowing from the third header 14*c* to join high-quality, low-pressure refrigerant being in the two-phase state or in the gas state and flowing from the second header 14*b*, and guides the refrigerant into part of the refrigerant passage which is located on a suction side of the compressor 10, through the second primary pipe 5*b* via the fifth opening and closing device 35.

The third parallel pipe 9 is provided with the fifth opening and closing device 35.

The first opening and closing device 31 is provided at the first inlet and outlet pipe 7*a* to allow or block flowing of the refrigerant flowing through the first inlet and outlet pipe 7*a*. That is, in the case where the first heat-source-side heat exchanger 13*a* is used as a condenser, the first opening and closing device 31 is opened to allow the refrigerant flowing from the first heat-source-side heat exchanger 13*a* to flow into the third heat-source-side heat exchanger 13*c*. In the case where the first heat-source-side heat exchanger 13*a* is not used as a condenser and at least one of the second heat-source-side heat exchanger 13*b* and the third heat-source-side heat exchanger 13*c* is used as a condenser, the first opening and closing device 31 is closed to block the passage of the refrigerant, thus preventing the refrigerant from flowing into the first heat-source-side heat exchanger 13*a*. Furthermore, in the case where the first heat-source-side heat exchanger 13*a*, the second heat-source-side heat exchanger 13*b* and the third heat-source-side heat exchanger 13*c* are used as evaporators, the first opening and closing device 31 is opened to allow the refrigerant to flow into the first heat-source-side heat exchanger 13*a*.

The first opening and closing device 31 is formed as an opening and closing valve capable of opening and closing the refrigerant passage, such as a two-way valve, a solenoid valve, or an electronic expansion valve.

The second opening and closing device 32 is provided at the series pipe 6 to allow or block flowing of the refrigerant flowing through the series pipe 6. That is, in the case where the third heat-source-side heat exchanger 13*c* and at least one of the first heat-source-side heat exchanger 13*a* and the second heat-source-side heat exchanger 13*b* are used as condensers, the second opening and closing device 32 is opened to allow the refrigerant flowing from at least one of the first heat-source-side heat exchanger 13*a* and the second heat-source-side heat exchanger 13*b* to flow into the third heat-source-side heat exchanger 13*c*. Furthermore, in the case where only the second heat-source-side heat exchanger 13*b* is used as a condenser, the second opening and closing device 32 is closed to block the passage of part of the refrigerant flowing from the second heat-source-side heat exchanger 13*b*, preventing the part of the refrigerant from flowing into the third heat-source-side heat exchanger 13*c*, Furthermore, in the case where the first heat-source-side heat exchanger 13*a*, the second heat-source-side heat exchanger 13*b* and the third heat-source-side heat exchanger 13*c* are used as evaporators, the second opening and closing device 32 is closed to block flowing of refrigerant, which is to be made to flow into the first heat-source-side heat exchanger 13*a* and the second heat-source-side heat exchanger 13*b*, toward the suction side of the compressor 10, thereby preventing part of the above refrigerant from flowing through a bypass toward the suction side of the compressor 10.

The second opening and closing device 32 is formed as an opening and closing valve capable of opening and closing the refrigerant passage, such as a two-way valve, a solenoid valve, or an electronic expansion valve.

The third opening and closing device 33 is provided at the first parallel pipe 8*a* to allow or block the passage of the refrigerant flowing through the first parallel pipe 8*a*. That is, in the case where the third heat-source-side heat exchanger 13*c* and at least one of the first heat-source-side heat exchanger 13*a* and the second heat-source-side heat exchanger 13*b* are used as condensers, the third opening and closing device 33 is closed to block the passage of the refrigerant flowing from at least one of the first heat-source-side heat exchanger 13*a* and the second heat-source-side heat exchanger 13*b*, thus preventing the refrigerant from flowing through a bypass to flow into the third heat-source-side heat exchanger 13*c*. In the case where only the second heat-source-side heat exchanger 13*b* is used as a condenser, the third opening and closing device 33 is opened to allow the refrigerant flowing from the second heat-source-side heat exchanger 13*b* to flow into the second main pipe 4*b*. Furthermore, in the case where the first heat-source-side heat exchanger 13*a*, the second heat-source-side heat exchanger 13*b* and the third heat-source-side heat exchanger 13*c* are used as evaporators, the third opening and closing device 33 is opened to allow the refrigerant flowing from the second main pipe 4*b* to flow into the first heat-source-side heat exchanger 13*a* and the second heat-source-side heat exchanger 13*b*. In this case, the third opening and closing device 33 is a flow control valve which controls the flow rate of refrigerant to be made to flow into the first heat-source-side heat exchanger 13*a* and the second heat-source-side heat exchanger 13*b* in the case where the first heat-source-side heat exchanger 13*a*, the second heat-source-side heat exchanger 13*b* and the third heat-source-side heat exchanger 13*c* are used as evaporators.

The third opening and closing device 33 is formed as an expansion device such as an electronic expansion device, whose opening degree is changed to control the flow rate of the refrigerant.

The fourth opening and closing device 34 is provided at the second parallel pipe 8*b* to allow or block flowing of the refrigerant flowing through the second parallel pipe 8*b*. To be more specific, in the case where the third heat-source-side heat exchanger 13*c* and at least one of the first heat-source-side heat exchanger 13*a* and the second heat-source-side heat exchanger 13*b* are used as condensers, the fourth opening and closing device 34 is opened to allow the refrigerant flowing from the third heat-source-side heat exchanger 13*c* to flow into the second main pipe 4*b*. In the case where only the second heat-source-side heat exchanger 13*b* is used as a condenser, the fourth opening and closing device 34 is closed to block the passage of the refrigerant flowing from the second heat-source-side heat exchanger 13*b*, thus preventing the refrigerant from flowing into the third heat-source-side heat exchanger 13*c*. Furthermore, in the case where the first heat-source-side heat exchanger 13*a*, the second heat-source-side heat exchanger 13*b* and the third heat-source-side heat exchanger 13*c* are used as evaporators, the fourth opening and closing device 34 is opened to allow the refrigerant flowing from the second main pipe 4*b* to flow into the third heat-source-side heat exchanger 13*c*. In this case, the fourth opening and closing device 34 is a flow control valve which controls the flow rate of refrigerant to be made to flow into the third heat-source-side heat exchanger 13*c* in the case where the first heat-source-side heat exchanger 13*a*, the second heat-source-side heat exchanger 13*b* and the third heat-source-side heat exchanger 13*c* are used as evaporators.

The fourth opening and closing device 34 is formed as an expansion device such as an electronic expansion valve, whose opening degree is changed to control the flow rate of the refrigerant.

The fifth opening and closing device 35 is provided at the third parallel pipe 9 to allow or block flowing of the refrigerant flowing through the third parallel pipe 9. To be more specific, in the case where at least one of the first heat-source-side heat exchanger 13*a*, the second heat-source-side heat exchanger 13*b* and the third heat-source-side heat exchanger 13*c* is used as a condenser, the fifth opening and closing device 35 is closed to block flowing of the refrigerant flowing from part of the refrigerant passage which is located on a discharge side of the compressor 10, toward the third heat-source-side heat exchanger 13*c*, thereby preventing part of the above refrigerant from flowing through a bypass to flow into the third heat-source-side heat exchanger 13*c*. In the case where the first heat-source-side heat exchanger 13*a*, the second heat-source-side heat exchanger 13*b*, and the third heat-source-side heat exchanger 13*c* are used as evaporators, the fifth opening and closing device 35 is opened to guide the refrigerant flowing from the third heat-source-side heat exchanger 13*c* to part of the refrigerant pipe 3 which is located on the suction side of the compressor 10.

The fifth opening and closing device 35 is formed as an opening and closing valve such as a two-way valve, a solenoid valve, or an electronic expansion valve, that can open and close the refrigerant passage. Alternatively, the fifth opening and closing device 35 is formed as a valve such as a check valve serving as a backflow preventing device which allows the passage of the refrigerant from the third heat-source-side heat exchanger 13*c*, and blocks the passage of refrigerant flowing from part of the refrigerant pipe 3 which is located on the discharge side of the compressor 10, thereby preventing the refrigerant from flowing into the third heat-source-side heat exchanger 13*c*.

Furthermore, the outdoor unit 1 is provided with a pressure sensor 41 which detects the pressure of the high-temperature, high-pressure refrigerant discharged from the compressor 10.

Also, the outdoor unit 1 is provided with an outdoor air temperature sensor 42 which detects the temperature of outdoor air.

[Indoor Unit 2]

The indoor unit 2 includes, as structural elements of the main circuit, the load-side heat exchanger 21 and the load-side expansion device 22.

The load-side heat exchanger 21 is connected to the outdoor unit 1 by the first main pipe 4*a* and the second main pipe 4*b*. The load-side heat exchanger 21 causes heat exchange to be performed between air which flows from an indoor space and refrigerant which flows into the load-side heat exchanger 21 through the first main pipe 4*a* or the second main pipe 4*b*, thereby generating heating air or cooling air to be supplied to the indoor space. It should be noted that the load-side heat exchanger 21 receives indoor air sent by an air-sending device not illustrated, such as a fan.

As the load-side expansion device 22, a device whose opening degree can be changed, such as an electronic expansion valve, is applied. The load-side expansion device 22 functions as a pressure reducing valve or an expansion valve to expand the refrigerant by reducing the pressure thereof. The load-side expansion device 22 is provided upstream of the load-side heat exchanger 21 in any of all the cooling operation modes.

A controller 60 constituted of, for example, a microcomputer, etc., is included in the outdoor unit 1, controls various devices in the air-conditioning apparatus 100 based on detection information obtained by detection by the above various sensors and instructions from a remote control unit. The controller 60 controls, for example, the driving frequency of the compressor 10, the rotation speed of the fan 16 and turning on and off of the fan 16, switching of the first four-way valve 11, switching of the second four-way valve 12, the opening degree or the opening and closing of the first opening and closing device 31, the opening degree or the opening and closing of the second opening and closing device 32, the opening degree or the opening and closing of the third opening and closing device 33, the opening degree or the opening and closing of the fourth opening and closing device 34, the opening degree or the opening and closing of the fifth opening and closing device 35, and the opening degree of the load-side expansion device 22, etc. The controller 60 thus controls the various devices to cause the air-conditioning apparatus 100 to operate in any of the operation modes which will be described later.

Although it is illustrated by way of example that the controller 60 is provided in the outdoor unit 1, controllers 60 may be provided in respective units, or the control 60 may be provided in the indoor unit 2.

The operation modes of the air-conditioning apparatus 100 will be described. The air-conditioning apparatus 100 is operated in the cooling operation mode or the heating operation mode based on an instruction from the indoor unit 2.

To be more specific, the operation modes of the air-conditioning apparatus 100 as illustrated in FIG. 1 include three cooling operation modes in each of which the indoor unit 2 is driven to perform the cooling operation, and a heating operation mode in which the indoor unit 2 is driven to perform the heating operation.

The operation modes will be described along with the flow of refrigerant.

[High-Load Cooling Operation Mode]

Figure 2:
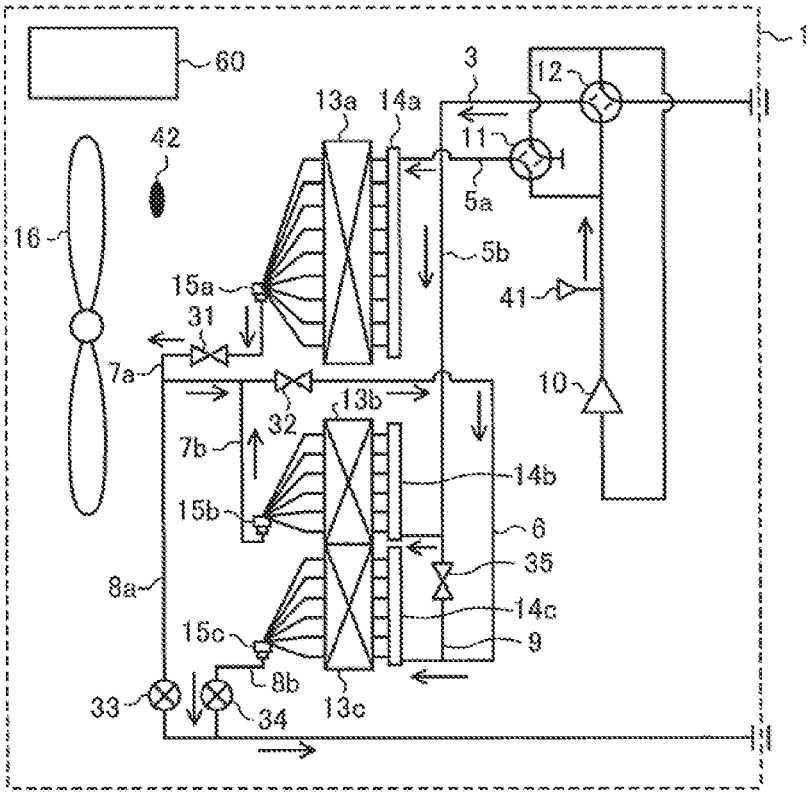
FIG. 2 is a refrigerant circuit diagram illustrating a flow of refrigerant in a high-load cooling operation mode of the air-conditioning apparatus according to embodiment 1 of the present invention.

FIG. 2 is a refrigerant circuit diagram illustrating the flow of refrigerant in the high-load cooling operation mode of the air-conditioning apparatus 100 according to embodiment 1 of the present invention.

FIG. 2 illustrates the flow of refrigerant in the high-load cooling operation mode in the case the load on the load-side heat exchanger 21 is a high cooling load. This case is an example. In FIG. 2, solid arrows indicate flow directions of the refrigerant.

It should be noted that the high-load cooling operation mode is applied when the controller 60 determines that a cooling load which is obtained from an outdoor air temperature detected by the outdoor air temperature sensor 42 and a refrigerant pressure detected by the pressure sensor 41 is higher than or equal to a first reference load, the refrigerant pressure being a refrigerant pressure from which a condensing temperature can be estimated.

As illustrated in FIG. 2, low-temperature, low-pressure refrigerant is compressed into high-temperature, high-pressure gas refrigerant by the compressor 10, and the high-temperature, high-pressure gas refrigerant is discharged therefrom. After discharged from the compressor 10, the high-temperature, high-pressure gas refrigerant is divided into two, and they flow into respective valves, that is, the first four-way valve 11 and the second four-way valve 12. Then, the high-temperature, high-pressure gas refrigerant flowing into the first four-way valve 11 flows into the first heat-source-side heat exchanger 13*a* through the first primary pipe 5*a*. The high-temperature, high-pressure gas refrigerant flowing into the second four-way valve 12 flows into the second heat-source-side heat exchanger 13*b* through the second primary pipe 5*b*. In this process, the state of the fifth opening and closing device 35 is switched to a closed state. Therefore, the high-temperature, high-pressure gas refrigerant flowing through the second primary pipe 5*b* does not flow into the third heat-source-side heat exchanger 13*c* via the third parallel pipe 9.

The gas refrigerant flowing into the first heat-source-side heat exchanger 13*a* is changed into high-pressure, two-phase or liquid refrigerant, while transferring heat to outdoor air supplied by the fan 16 in the first heat-source-side heat exchanger 13*a*. Furthermore, the gas refrigerant flowing into the second heat-source-side heat exchanger 13*b* is changed into high-pressure, two-phase or liquid refrigerant, while transferring heat to outdoor air supplied by the fan 16 in the second heat-source-side heat exchanger 13*b*.

The high-pressure, two-phase or liquid refrigerant flowing from the first heat-source-side heat exchanger 13*a* flows into the series pipe 6 through the first inlet and outlet pipe 7*a*, with the first opening and closing device 31, which is provided thereat, being in the opened state. Furthermore, the high-pressure, two-phase or liquid refrigerant flowing from the second heat-source-side heat exchanger 13*b* flows into the series pipe 6 through the second inlet and outlet pipe 7*b*. Thereby, the high-pressure, two-phase or liquid refrigerant flowing from the first heat-source-side heat exchanger 13*a* and the high-pressure, two-phase or liquid refrigerant flowing from the second heat-source-side heat exchanger 13*b* join each other in the series pipe 6. In this process, the state of the third opening and closing device 33 is switched to the closed state. Therefore, the high-pressure, two-phase or liquid refrigerant flowing from the first heat-source-side heat exchanger 13*a* or the second heat-source-side heat exchanger 13*b* does not flow into the second main pipe 4*b* via the first parallel pipe 8*a*.

The high-pressure, two-phase or liquid refrigerant obtained by the above joining flows into the third heat-source-side heat exchanger 13*c* through the series pipe 6, with the second opening and closing device 32, which is provided thereat, being in the opened state. In the third heat-source-side heat exchanger 13*c*, the high-pressure, two-phase or liquid refrigerant flowing thereinto is changed into high-pressure liquid refrigerant, while transferring heat to the outdoor air supplied by the fan 16. The high-pressure liquid refrigerant flows out of the outdoor unit 1 through the second parallel pipe 8*b*, with the fourth opening and closing device 34, which is provided thereat, being in the opened state, and then flows into the indoor unit 2 through the second main pipe 4*b*.

To be more specific, in the outdoor unit 1, in the case where the first heat-source-side heat exchanger 13*a*, the second heat-source-side heat exchanger 13*b* and the third heat-source-side heat exchanger 13*c* are used as condensers, on the upstream side, the first heat-source-side heat exchanger 13*a* and the second heat-source-side heat exchanger 13*b* are connected parallel to each other, and on the downstream side, the third heat-source-side heat exchanger 13*c* is connected in series to the first heat-source-side heat exchanger 13*a* and the second heat-source-side heat exchanger 13*b* at a first series refrigerant passage.

In the case where the first heat-source-side heat exchanger 13*a*, the second heat-source-side heat exchanger 13*b* and the third heat-source-side heat exchanger 13*c* are used as condensers, the first four-way valve 11 allows the refrigerant discharged from the compressor 10 to flow into the first heat-source-side heat exchanger 13*a*, the second four-way valve 12 allows the refrigerant discharged from the compressor 10 to flow into the second heat-source-side heat exchanger 13*b*, the first opening and closing device 31 is opened, the second opening and closing device 32 is opened, the third opening and closing device 33 is closed, the fourth opening and closing device 34 is opened, and the fifth opening and closing device 35 is closed.

In the indoor unit 2, the high-pressure liquid refrigerant is expanded by the load-side expansion device 22 to change into low-temperature, low-pressure, two-phase gas-liquid refrigerant. The two-phase gas-liquid refrigerant flows into the load-side heat exchanger 21 which functions as an evaporator, and receives heat from the indoor air, thereby changing into low-temperature, low-pressure gas refrigerant while cooling the indoor air. In this process, the opening degree of the load-side expansion device 22 is controlled by the controller 60 such that the degree of superheat is constant. The gas refrigerant flowing from the load-side heat exchanger 21 re-flows into the outdoor unit 1 through the first main pipe 4*a*. The gas refrigerant flowing into the outdoor unit 1 is re-sucked into the compressor 10 through the second four-way valve 12.

In the high-load cooling operation mode, the third heat-source-side heat exchanger 13*c* is connected in series to the first heat-source-side heat exchanger 13*a* and the second heat-source-side heat exchanger 13*b*, as described above. Thereby, the flow velocity of the refrigerant is increased, and the performance of the condensers is improved. Accordingly, it is possible to reduce occurrence of refrigerant accumulation in which the refrigerant stays and accumulates as liquid refrigerant in the third heat-source-side heat exchanger 13*c* on the downstream side in the case where the flow velocity of the refrigerant is low.

The first heat-source-side heat exchanger 13*a* is independently provided, and is not divided. The first heat-source-side heat exchanger 13*a* is provided with a single first header 14*a* and a single first distributor 15*a*. Furthermore, part of the second heat-source-side heat exchanger 13*b* and part of the third heat-source-side heat exchanger 13*c* are formed integrally with each other. However, the second heat-source-side heat exchanger 13*b* is provided with a single second header 14*b* and a single second distributor 15*b*. Also, the third heat-source-side heat exchanger 13*c* is provided with a single third header 14*c* and a single third distributor 15*c*. It is therefore reduce the manufacturing cost, and also reduce the space for installing the devices, as compared with a configuration in which a single heat-source-side heat exchanger is provided with two or more headers and two or more distributors as in a conventional air-conditioning apparatus.

In addition, in the high-load cooling operation mode, the capacity on the upstream side of the heat-source-side heat exchangers connected in series, that is, the capacity of the first heat-source-side heat exchanger 13*a* and the second heat-source-side heat exchanger 13*b* connected in parallel, is adjusted larger than the capacity on the downstream side, that is, the capacity of the third heat-source-side heat exchanger 13*c*. This is intended to adjust the capacity ratio between the capacity on the upstream side and the capacity on the downstream side to cause the inflowing refrigerant in the third heat-source-side heat exchanger 13*c* on the downstream side to change into low-quality refrigerant in order to maximize the efficiency of all of the heat-source-side heat exchangers.

[Heating Operation Mode]

Figure 3:
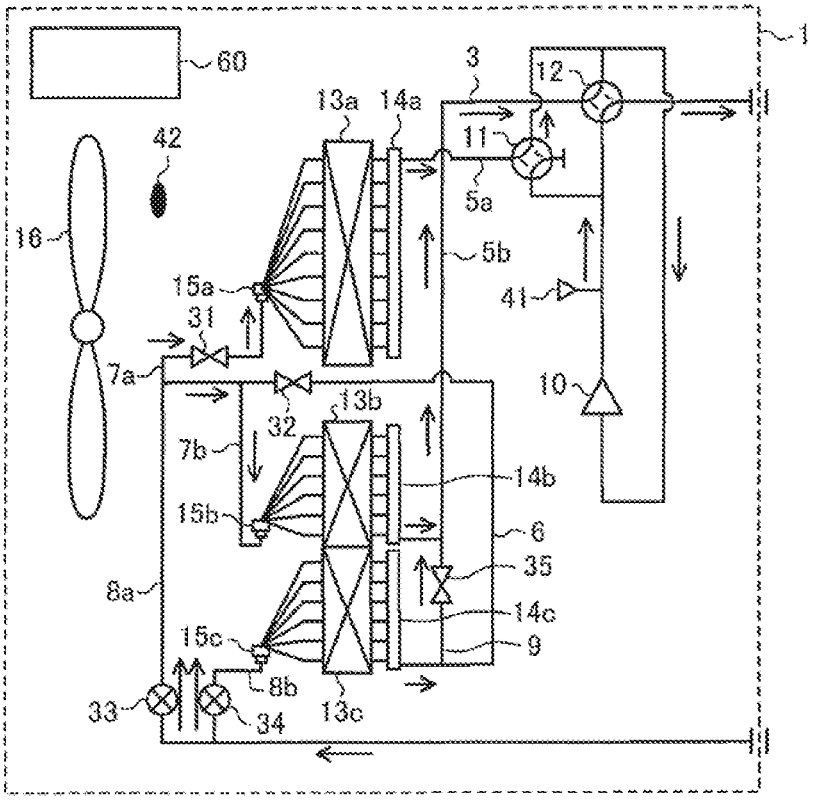
FIG. 3 is a refrigerant circuit diagram illustrating a flow of refrigerant in a heating operation mode of the air-conditioning apparatus according to embodiment 1 of the present invention.

FIG. 3 is a refrigerant circuit diagram illustrating the flow of refrigerant in the heating operation mode of the air-conditioning apparatus 100 according to embodiment 1 of the present invention.

FIG. 3 illustrates the flow of refrigerant in the heating operation mode in the case where the load on the load-side heat exchanger 21 is a heating load. This case is an example. In FIG. 3, solid arrows indicate flow directions of the refrigerant.

As illustrated in FIG. 3, low-temperature, low-pressure refrigerant is compressed into high-temperature, high-pressure gas refrigerant by the compressor 10, and the high-temperature, high-pressure gas is discharged from the compressor 10. After discharged from the compressor 10, the high-temperature, high-pressure gas refrigerant passes through the second four-way valve 12, and flows out of the outdoor unit 1. The high-temperature, high-pressure gas refrigerant flowing out of the outdoor unit 1 passes through the first main pipe 4*a*, and transfers heat to the indoor air in the load-side heat exchanger 21, thereby changing into liquid refrigerant while heating the indoor space. In this process, the opening degree of the load-side expansion device 22 is controlled by the controller 60 such that the degree of subcooling is made constant. The liquid refrigerant flowing from the load-side heat exchanger 21 is expanded by the load-side expansion device 22 to change into intermediate-temperature, intermediate-pressure, two-phase gas-liquid refrigerant, and re-flows into the outdoor unit 1 through the second main pipe 4*b*.

The intermediate-temperature, intermediate-pressure, two-phase gas-liquid refrigerant flowing into the outdoor unit 1 is divided into two refrigerants, which flow into respective flow passages, that is, the first parallel pipe 8*a* and the second parallel pipe 8*b*.

One of the refrigerants into which the refrigerant flowing into the outdoor unit 1 are divided passes through the first parallel pipe 8*a*, with the third opening and closing device 33, which is provided thereat, being in the opened state, and is further divided into two refrigerants, which flow into respective flow passages. That is, the divided two refrigerants flow into the first inlet and outlet pipe 7*a*, with the first opening and closing device 31, which is provided thereof, being in the opened state, and the second inlet and outlet pipe 7*b* via the series pipe 6, and then flow into the first heat-source-side heat exchanger 13*a* and the second heat-source-side heat exchanger 13*b*, respectively. In this process, the state of the second opening and closing device 32 is switched to the closed state. Therefore, the refrigerant flowing through the series pipe 6 does not flow backward into the third header 14*c* of the third heat-source-side heat exchanger 13*c*.

On the other hand, the remaining one of the refrigerants into which the refrigerant flowing into the outdoor unit 1 are divided passes through the second parallel pipe 8*b*, with the fourth opening and closing device 34, which is provided thereat, being in the opened state, and then flows into the third heat-source-side heat exchanger 13*c*.

It should be noted that the opening degree of the third opening and closing device 33 is changed to adjust the amount of refrigerant to be made to flow into the first heat-source-side heat exchanger 13*a* and the second heat-source-side heat exchanger 13*b* in the heating operation mode. Also, the opening degree of the fourth opening and closing device 34 is changed to adjust the amount of refrigerant to be made to flow into the third heat-source-side heat exchanger 13*c* in the heating operation mode.

After flowing into the first heat-source-side heat exchanger 13*a*, the second heat-source-side heat exchanger 13*b*, and the third heat-source-side heat exchanger 13*c*, the refrigerant is changed into low-temperature, low-pressure gas refrigerant, while receiving heat from the outdoor air in the first heat-source-side heat exchanger 13*a*, the second heat-source-side heat exchanger 13*b*, and the third heat-source-side heat exchanger 13*c*.

Thereafter, the refrigerant flowing from the first heat-source-side heat exchanger 13*a* flows to the suction side of the compressor 10 through the first four-way valve 11. The refrigerant flowing from the third heat-source-side heat exchanger 13*c* flows through the third parallel pipe 9, with the fifth opening and closing device 35, which is provided thereat, being in the opened state. The refrigerant flowing from the third heat-source-side heat exchanger 13*c* and flowing through the third parallel pipe 9 joins, in the second primary pipe 5*b*, the refrigerant flowing from the second heat-source-side heat exchanger 13*b*, and flows to the suction side of the compressor 10 through the second four-way valve 12.

That is, in the case where the first heat-source-side heat exchanger 13*a*, the second heat-source-side heat exchanger 13*b* and the third heat-source-side heat exchanger 13*c* are used as evaporators, the first heat-source-side heat exchanger 13*a*, the second heat-source-side heat exchanger 13*b* and the third heat-source-side heat exchanger 13*c* are connected in parallel to each other in a parallel refrigerant passage.

The parallel refrigerant passage is configured such that the passage of the refrigerant discharged from the compressor 10 is blocked by the first four-way valve 11, the passage of the refrigerant discharged from the compressor 10 is allowed by the second-four-way valve 12 to flow into the load-side heat exchanger 21, the first opening and closing device 31 is opened, the second opening and closing device 32 is closed, the third opening and closing device 33 is opened, the fourth opening and closing device 34 is opened, and the fifth opening and closing device 35 is opened.

In the heating operation mode, the first heat-source-side heat exchanger 13*a*, the second heat-source-side heat exchanger 13*b* and the third heat-source-side heat exchanger 13*c* are connected in parallel, as described above. By virtue of this, the pressure loss of the refrigerant flowing through the first heat-source-side heat exchanger 13*a*, the second heat-source-side heat exchanger 13*b* and the third heat-source-side heat exchanger 13*c* is reduced, and the performance of the evaporators is improved.

[Intermediate-Load Cooling Operation Mode]

During a cooling operation, when the outdoor air temperature is low, the capacity of the first heat-source-side heat exchanger 13*a*, the second heat-source-side heat exchanger 13*b* and the third heat-source-side heat exchanger 13*c* is excessively large with respect to the flow rate of the refrigerant, and as a result the efficiency of the condensers is reduced. To be more specific, if a required flow rate of refrigerant is reduced, the pressures on high-pressure sides of the condensers are reduced, and the capacity of the condensers are excessively increased, refrigerant accumulation occurs in which condensed refrigerant accumulates in a condenser as liquid refrigerant, thereby reducing the heat exchange efficiency. In view of this point, the capacity of the condensers in which the refrigerant flows is reduced in accordance with the reduction of the outdoor air temperature. Therefore, it will be described how the refrigerant is not made to flow into the first heat-source-side heat exchanger 13*a* but is made to flow into the second heat-source-side heat exchanger 13*b* and the third heat-source-side heat exchanger 13*c* connected in series.

Figure 4:
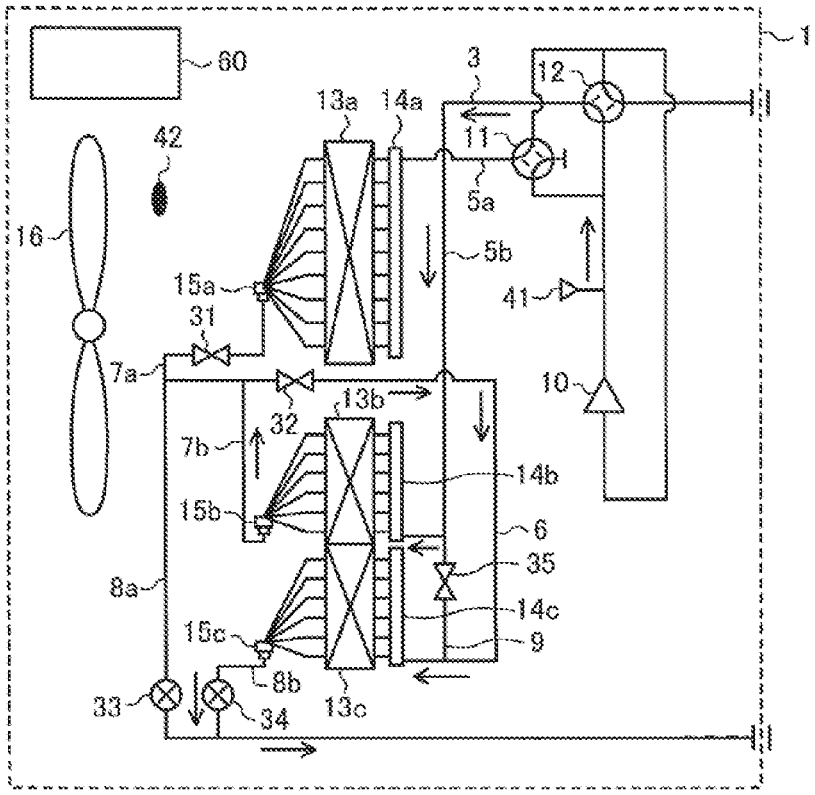
FIG. 4 is a refrigerant circuit diagram illustrating a flow of refrigerant in an intermediate-load cooling operation mode of the air-conditioning apparatus according to embodiment 1 of the present invention.

FIG. 4 is a refrigerant circuit diagram illustrating the flow of refrigerant in the intermediate-load cooling operation mode of the air-conditioning apparatus 100 according to embodiment 1 of the present invention.

To be more specific, FIG. 4 illustrates the flow of refrigerant in the intermediate-load cooling operation mode in the case where the load on the load-side heat exchanger 21 is an intermediate cooling load. This case is an example. In FIG. 4, solid arrows indicate the flow directions of the refrigerant.

It should be noted that the intermediate-load cooling operation mode is applied when the controller 60 determines that a cooling load, which is obtained from an outdoor air temperature detected by the outdoor air temperature sensor 42 and a refrigerant pressure detected by the pressure sensor 41 is lower than the first reference load, and higher than or equal to a second reference load, the refrigerant pressure detected by the pressure sensor 41 being a refrigerant pressure from which a condensing temperature detected by the pressure sensor 41 can be estimated. It should be noted that the second reference load is set to a cooling load lower than the first reference load.

As illustrated in FIG. 4, low-temperature, low-pressure refrigerant is compressed into high-temperature, high-pressure gas refrigerant by the compressor 10, and the high-temperature, high-pressure gas refrigerant is discharged from the compressor 10. After discharged from the compressor 10, the high-temperature, high-pressure gas refrigerant flows into the second four-way valve 12. It should be noted that since the first four-way valve 11 is switched to block up the flow passage, the refrigerant does not flow from the first four-way valve 11 into the first heat-source-side heat exchanger 13*a*. Furthermore, after flowing into the second four-way valve 12, the gas refrigerant flows into the second heat-source-side heat exchanger 13*b* through the second primary pipe 5*b*. In this process, the state of the fifth opening and closing device 35 is switched to the closed state. Therefore, the high-temperature, high-pressure gas refrigerant flowing through the second primary pipe 5*b* does not flow into the third heat-source-side heat exchanger 13*c* via the third parallel pipe 9.

In the second heat-source-side heat exchanger 13*b*, the gas refrigerant is changed into high-pressure, two-phase or liquid refrigerant, while transferring heat to the outdoor air supplied by the fan 16 in the second heat-source-side heat exchanger 13*b*.

After flowing out of the second heat-source-side heat exchanger 13*b*, the high-pressure, two-phase or liquid refrigerant flows into the series pipe 6 through the second inlet and outlet pipe 7*b*. In this process the states of the first opening and closing device 31 and the third opening and closing device 33 are switched to the closed state. Therefore, the high-pressure, two-phase or liquid refrigerant flowing from the second heat-source-side heat exchanger 13*b* neither flows backward into the first heat-source-side heat exchanger 13*a* from the first inlet and outlet pipe 7*a* nor flows into the second main pipe 4*b* via the first parallel pipe 8*a*.

The high-pressure, two-phase or liquid refrigerant flowing from the second heat-source-side heat exchanger 13*b* flows into the third heat-source-side heat exchanger 13*c* through the series pipe 6, with the second opening and closing device 32, which is provided thereat, being in the opened state. In the third heat-source-side heat exchanger 13*c*, the high-pressure, two-phase or liquid refrigerant is changed into high-pressure liquid refrigerant, while transferring heat to the outdoor air supplied by the fan 16. The high-pressure liquid refrigerant flows out from the outdoor unit 1 through the second parallel pipe 8*b*, with the fourth opening and closing device 34, which is provided thereat, being in the opened state, and then flows into the indoor unit 2 through the second main pipe 4*b*.

That is, in the outdoor unit 1, in the case where the second heat-source-side heat exchanger 13*b* and the third heat-source-side heat exchanger 13*c* are used as condensers, a second series refrigerant passage is applied. In the second series refrigerant passage, on the upstream side, the second heat-source-side heat exchanger 13*b* is located, and on the downstream side, the third heat-source-side heat exchanger 13*c* is connected in series to the second heat-source-side heat exchanger 13*b*.

In the second series refrigerant passage, in the case where the second heat-source-side heat exchanger 13*b* and the third heat-source-side heat exchanger 13*c* are used as condensers, the first four-way valve 11 is caused to block the passage of the refrigerant discharged from the compressor 10, the second four-way valve 12 is caused to allow the refrigerant discharged from the compressor 10 to flow to the second heat-source-side heat exchanger 13*b*, the first opening and closing device 31 is closed, the second opening and closing device 32 is opened, the third opening and closing device 33 is closed, the fourth opening and closing device 34 is opened, and the fifth opening and closing device 35 is closed.

[Low-Load Cooling Operation Mode]

In the cooling operation, when the outdoor air temperature is lower, the capacity of the second heat-source-side heat exchanger 13*b* and the third heat-source-side heat exchanger 13*c* is excessively large with respect to the flow rate of the refrigerant, thereby reducing the efficiency of the condensers. To be more specific, if a required flow rate of refrigerant is decreased, the pressures on the high-pressure side of the condensers are decreased, and the capacity of the condensers is excessively increased, refrigerant accumulation occurs in which condensed refrigerant accumulates in a condenser as liquid refrigerant, thereby reducing the heat exchange efficiency. In view of this point, the capacity of the condensers in which the refrigerant flows is further reduced in accordance with the further reduction of the outdoor air temperature. Therefore, it will be described how the refrigerant is not made to flow in the first heat-source-side heat exchanger 13*a* or the third heat-source-side heat exchanger 13*c*, but are made to flow in the third heat-source-side heat exchanger 13*b* only.

Figure 5:
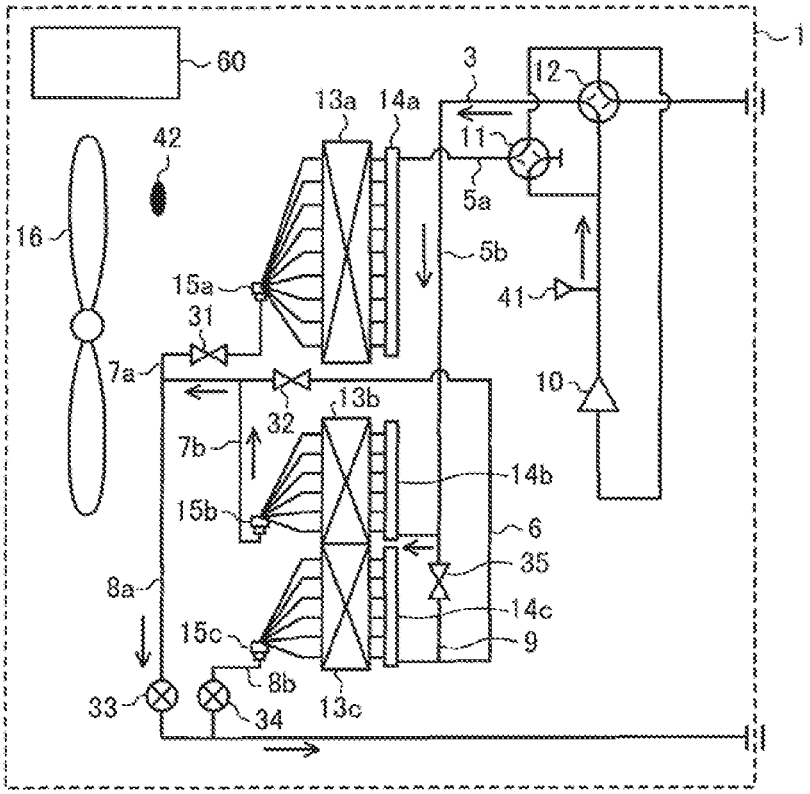
FIG. 5 is a refrigerant circuit diagram illustrating a flow of refrigerant in a low-load cooling operation mode of the air-conditioning apparatus according to embodiment 1 of the present invention.

FIG. 5 is a refrigerant circuit diagram illustrating the flow of refrigerant in the low-load cooling operation mode of the air-conditioning apparatus 100 according to embodiment 1 of the present invention.

Also, FIG. 5 illustrates the flow of refrigerant in the low-load cooling operation mode in the case where the load on the load-side heat exchanger 21 is a low cooling load. This case is an example. In FIG. 5, solid arrows indicate the flow directions of the refrigerant.

In the case where the low-load cooling operation mode is applied when the controller 60 determines that the cooling load, which is obtained from an outdoor air temperature detected by the outdoor air temperature sensor 42 and a refrigerant pressure detected by the pressure sensor 41, is lower than the second reference load, the outdoor air temperature being an outdoor air temperature from which a condensing temperature can be estimated.

As illustrated in FIG. 5, low-temperature, low-pressure refrigerant is compressed into high-temperature, high-pressure gas refrigerant by the compressor 10, and the high-temperature, high-pressure gas refrigerant is discharged from the compressor 10. After discharged from the compressor 10, the high-temperature, high-pressure gas refrigerant flows into the second four-way valve 12. It should be noted that the first four-way valve 11 is switched to block up the flow passage as in the intermediate-load cooling operation mode, and thus does not allow the refrigerant to flow into the first heat-source-side heat exchanger 13*a*. Then, the refrigerant flowing into the second four-way valve 12 flows into the second heat-source-side heat exchanger 13*b* through the second primary pipe 5*b*. In this process, the state of the fifth opening and closing device 35 is switched to the closed state. Therefore, the high-temperature, high-pressure gas refrigerant flowing through the second primary pipe 5*b* does not flow into the third heat-source-side heat exchanger 13*c* via the third parallel pipe 9.

The gas refrigerant flowing into the second heat-source-side heat exchanger 13*b* is changed into high-pressure liquid refrigerant, while transferring heat to the outdoor air supplied by the fan 16.

After flowing out of the second heat-source-side heat exchanger 13*b*, the high-pressure liquid refrigerant flows into the series pipe 6 through the second inlet and outlet pipe 7*b*. In this process, the states of the first opening and closing device 31 and the second opening and closing device 32 are switched to the closed state. Therefore, the high-pressure liquid refrigerant flowing out of the second heat-source-side heat exchanger 13*b* neither flows backward into the first heat-source-side heat exchanger 13*a* from the first inlet and outlet pipe 7*a* nor flows into the third heat-source-side heat exchanger 13*c* via the series pipe 6.

The high-pressure liquid refrigerant flowing into the series pipe 6 flows out of the outdoor unit 1 through the first parallel pipe 8*a*, with the third opening and closing device 33 which is provided at, being in the opened state, and flows into the indoor unit 2 through the second main pipe 4*b*.

That is, in the outdoor unit 1, in the case where the second heat-source-side heat exchanger 13*b* is used as a condenser, a single refrigerant passage using only the second heat-source-side heat exchanger 13*b* is applied.

In the single refrigerant passage, the first four-way valve 11 is caused to block the passage of the refrigerant discharged from the compressor 10, the second four-way valve 12 is caused to allow the refrigerant discharged from the compressor 10 to flow into the second heat-source-side heat exchanger 13*b*, the first opening and closing device 31 is closed, the second opening and closing device 32 is closed, the third opening and closing device 33 is opened, the fourth opening and closing device 34 is closed, and the fifth opening and closing device 35 is closed.

As described above, according to embodiment 1, the air-conditioning apparatus 100 includes a main circuit in which the compressor 10, the first four-way valve 11, the second four-way valve 12, the load-side heat exchanger 21, the load-side expansion device 22, and at least the first heat-source-side heat exchanger 13*a*, the second heat-source-side heat exchanger 13*b*, and the third heat-source-side heat exchanger 13*c* are connected by the refrigerant pipes 3 to circulate the refrigerant. In the case where the first heat-source-side heat exchanger 13*a*, the second heat-source-side heat exchanger 13*b* and the third heat-source-side heat exchanger 13*c* are used as condensers, on the upstream side, the first heat-source-side heat exchanger 13*a* and the second heat-source-side heat exchanger 13*b* are connected in parallel to each other, and on the downstream side, the third heat-source-side heat exchanger 13*c* is connected in series to the first heat-source-side heat exchanger 13*a* and the second heat-source-side heat exchanger 13*b* in the first series refrigerant passage. In the case where the first heat-source-side heat exchanger 13*a*, the second heat-source-side heat exchanger 13*b* and the third heat-source-side heat exchanger 13*c* are used as evaporators, the first heat-source-side heat exchanger 13*a*, the second heat-source-side heat exchanger 13*b* and the third heat-source-side heat exchanger 13*c* are connected in parallel to each other in the parallel refrigerant passage. The air-conditioning apparatus 100 includes the heat-exchanger flow-passage switching device which is switched to use the first series refrigerant passage in the case where the first heat-source-side heat exchanger 13*a*, the second heat-source-side heat exchanger 13*b* and the third heat-source-side heat exchanger 13*c* are used as condensers, and which is switched to use the parallel refrigerant passage in the case where the first heat-source-side heat exchanger 13*a*, the second heat-source-side heat exchanger 13*b* and the third heat-source-side heat exchanger 13*c* are used as evaporators. The heat-exchanger flow-passage switching device includes the first opening and closing device 31, the second opening and closing device 32, the third opening and closing device 33, the fourth opening and closing device 34 and the fifth opening and closing device 35.

In the above configuration, the heat-exchanger flow-passage switching device of the air-conditioning apparatus 100 is switched to use the first series refrigerant passage in the case where the first heat-source-side heat exchanger 13*a*, the second heat-source-side heat exchanger 13*b* and the third heat-source-side heat exchanger 13*c* are used as condensers, and is switched to use the parallel refrigerant passage in the case where the first heat-source-side heat exchanger 13*a*, the second heat-source-side heat exchanger 13*b* and the third heat-source-side heat exchanger 13*c* are used as evaporators. Thereby, in the case where the operation is switched between the cooling operation and the heating operation, it is possible to switch the flow passage of the first heat-source-side heat exchanger 13*a*, the second heat-source-side heat exchanger 13*b* and the third heat-source-side heat exchanger 13*c* between the series passage and the parallel passage. To be more specific, in the first series refrigerant passage, in the case where the first heat-source-side heat exchanger 13*a*, the second heat-source-side heat exchanger 13*b* and the third heat-source-side heat exchanger 13*c* are used as condensers, on the upstream side, the first heat-source-side heat exchanger 13*a* and the second heat-source-side heat exchanger 13*b* are connected in parallel to each other, and on the downstream side, the third heat-source-side heat exchanger 13*c* is connected in series to the first heat-source-side heat exchanger 13*a* and the second heat-source-side heat exchanger 13*b*. Therefore, in the first series refrigerant passage, only the third heat-source-side heat exchanger 13*c* is located on the downstream side of the evaporator, and thus the capacity on the downstream side of the evaporator is small. Thus, even the flow velocity of the refrigerant is slow, it is possible to reduce occurrence of refrigerant accumulation in which liquid refrigerant accumulates on the downstream side of the evaporator, and thus cause the refrigerant to satisfactorily circulate.

In embodiment 1, the first heat-source-side heat exchanger 13*a* includes the single first header 14*a* and the single first distributor 15*a*: the second heat-source-side heat exchanger 13*b* includes the single second header 14*b* and the single second distributor 15*b*; and the third heat-source-side heat exchanger 13*c* includes the single third header 14*c* and the single third distributor 15*c*.

In the above configuration, each of all the above heat-source-side heat exchangers includes a single header and a single distributor. It is therefore possible to reduce the manufacturing cost and the space for installing these elements, as compared with a conventional configuration in which each heat-source-side heat exchanger includes two or more headers and two or more distributors.

In embodiment 1, in the case where the cooling load on the load-side heat exchanger 21 is higher than or equal to the first reference load, and the first heat-source-side heat exchanger 13*a*, the second heat-source-side heat exchanger 13*b* and the third heat-source-side heat exchanger 13*c* are used as condensers, the heat-exchanger flow-passage switching device is switched to use the first series refrigerant passage. In the case where the cooling load in the load-side heat exchanger 21 is lower than the first reference load and higher than or equal to the second reference load, and the second heat-source-side heat exchanger 13*b* and the third heat-source-side heat exchanger 13*c* are used as condensers, the heat-exchanger flow-passage switching device is switched to use the second series refrigerant passage in which on the upstream side, the second heat-source-side heat exchanger 13*b* is located, and on the downstream side, the third heat-source-side heat exchanger 13*c* is connected in series to the second heat-source-side heat exchanger 13*b*.

In the above configuration, during the cooling operation; the total capacity of the condensers can be reduced in a single refrigerant circuit; that is, the above refrigerant circuit. Furthermore, during the cooling operation, in the case where at least two of the first heat-source-side heat exchanger 13*a*, the second heat-source-side heat exchanger 13 and the third heat-source-side heat exchanger 13*c* are used as condensers, it is possible to optimize the capacity ratio between the condensers and thus to maximize the improvement of performance in the cooling. In addition, the capacity of the condensers can be adjusted in accordance with the cooling load; using the heat-exchanger flow-passage switching device.

In embodiment 1, in the case where the cooling load on the load-side heat exchanger 21 is lower than the second reference load, and the second heat-source-side heat exchanger 13*b* is used as a condenser, the heat-exchanger flow-passage switching device is switched to use the single refrigerant passage which uses only the second heat-source-side heat exchanger 13*b*.

In the above configuration, in the cooling operation, the capacity of the condensers can be reduced in the single refrigerant circuit. Furthermore, in the cooling operation, in the case where at least one of the first heat-source-side heat exchanger 13*a*, the second heat-source-side heat exchanger 13*b* and the third heat-source-side heat exchanger 13*c* is used as a condenser, it is possible to optimize the capacity ratio between the condensers, and thus maximize the efficiency of the cooling performance. In addition; the capacity of the condensers can be adjusted in accordance with the cooling load, using the heat-exchanger flow-passage switching device.

In embodiment 1, the refrigerant-flow switching device includes the first four-way valve 11 which allows or blocks flowing of the refrigerant discharged from the compressor 10 to the first heat-source-side heat exchanger 13*a*. The refrigerant-flow switching device includes the second four-way valve 12 which allows the refrigerant discharged from the compressor 10 to flow into the second heat-source-side heat exchanger 13*b* or the load-side heat exchanger 21. The heat-exchanger flow-passage switching device includes the first opening and closing device 31, the second opening and closing device 32, the third opening and closing device 33, the fourth opening and closing device 34 and the fifth opening and closing device 35. The first opening and closing device 31 is provided at the first inlet and outlet pipe 7*a* connected to part of the series pipe 6 which is located close to the first heat-source-side exchanger 13*a*, and which connects the first heat-source-side heat exchanger 13*a*, the second heat-source-side heat exchanger 13*b* and the third heat-source-side heat exchanger 13*c* in series. The first opening and closing device 31 allows or blocks flowing of the refrigerant flowing through the first inlet and outlet pipe 7*a*. The second opening and closing device 32 is provided at the series pipe 6, and allows or blocks flowing of the refrigerant flowing through the series pipe 6. The third opening and closing device 33 is provided at the first parallel pipe 8*a* which connects the connection part at which the first inlet and outlet pipe 7*a* and the series pipe 6 are connected to each other and the second main pipe 4*b* extending to the load-side expansion device 22. The third opening and closing device 33 allows or blocks flowing of the refrigerant flowing through the first parallel pipe 8*a*. The fourth opening and closing device 34 is provided at the second parallel pipe 8*b* connected to part of the second main pipe 4*b* which is close to the third heat-source-side heat exchanger 13*c*, and allows or blocks flowing of the refrigerant flowing through the second parallel pipe 8*b*. The fifth opening and closing device 35 is provided at the third parallel pipe 9 connecting the second four-way valve 12 and the third heat-source-side heat exchanger 13*c*, and allows or blocks flowing of the refrigerant flowing through the third parallel pipe 9. In the first series refrigerant passage, the first four-way valve 11 is made to allow the refrigerant discharged from the compressor 10 to flow into the first heat-source-side heat exchanger 13*a*, the second four-way valve 12 is made to allow the refrigerant discharged from the compressor 10 to flow into the second heat-source-side heat exchanger 13*b*, the first opening and closing device 31 is opened, the second opening and closing device 32 is opened, the third opening and closing device 33 is closed, the fourth opening and closing device 34 is opened, and the fifth opening and closing device 35 is closed. In the parallel refrigerant passage, the first four-way valve 11 is made to block the passage of the refrigerant discharged from the compressor 10, the second four-way valve 12 is made to allow the refrigerant discharged from the compressor 10 to flow into the load-side heat exchanger 21, the first opening and closing device 31 is opened, the second opening and closing device 32 is closed, the third opening and closing device 33 is opened, the fourth opening and closing device 34 is opened, and the fifth opening and closing device 35 is opened.

In the above configuration, in the case where the first heat-source-side heat exchanger 13*a*, the second heat-source-side heat exchanger 13*b* and the third heat-source-side heat exchanger 13*c* are used as condensers, on the upstream side, the first heat-source-side heat exchanger 13*a* and the second heat-source-side heat exchanger 13*b* can be connected in parallel to each other, and on the downstream side, the third heat-source-side heat exchanger 13*c* can be connected in series to the first heat-source-side heat exchanger 13*a* and the second heat-source-side heat exchanger 13*b* in the first series refrigerant passage. In the case where the first heat-source-side heat exchanger 13*a*, the second heat-source-side heat exchanger 13*b* and the third heat-source-side heat exchanger 13*c* are used as evaporators, the first heat-source-side heat exchanger 13*a*, the second heat-source-side heat exchanger 13*b* and the third heat-source-side heat exchanger 13*c* can be connected in parallel to each other in the parallel refrigerant passage.

According to embodiment 1, each of the third opening and closing device 33 and the fourth opening and closing device 34 is an expansion device the opening degree of which is changed to adjust the flow rate. In the heat-exchanger flow-passage switching device, in the case where the parallel refrigerant passage is applied, the opening degrees of the third opening and closing device 33 and the fourth opening and closing device 34 are changed to adjust the flow rates of refrigerant to be made to flow into the first heat-source-side heat exchanger 13*a*, the second heat-source-side heat exchanger 13*b* and the third heat-source-side heat exchanger 13*c*.

In the above configuration, in the case where the first heat-source-side heat exchanger 13*a*, the second heat-source-side heat exchanger 13*b* and the third heat-source-side heat exchanger 13*c* are used as evaporators, it is possible to optimally distribute refrigerant to the first heat-source-side heat exchanger 13*a*, the second heat-source-side heat exchanger 13*b* and the third heat-source-side heat exchanger 13*c*.

According to embodiment 1, the fifth opening and closing device 35 may be formed as a backflow preventing device which prevents, in the third parallel pipe 9, the refrigerant from flowing from part of the flow passage which is located on the inlet side of the second heat-source-side heat exchanger 13*b* into part of the flowing passage which is located on the inlet side of the third heat-source-side heat exchanger 13*c* in the case where the first heat-source-side heat exchanger 13*a*, the second heat-source-side heat exchanger 13*b* and the third heat-source-side heat exchanger 13*c* are used as condensers.

In the above configuration, only when the first heat-source-side heat exchanger 13*a*, the second heat-source-side heat exchanger 13*b* and the third heat-source-side heat exchanger 13*c* are used as evaporators, the refrigerant is allowed to flow, in the third parallel pipe 9, from part of the flow passage which is located on the outlet side of the third heat-source-side heat exchanger 13*c* and join the refrigerant in part of the flow passage which is located on the outlet side of the second heat-source-side heat exchanger 13*b*.

According to embodiment 1, the second series refrigerant passage is provided such that the first four-way valve 11 is made to block flowing of the refrigerant discharged from the compressor 10, the second four-way valve 12 is made to allow the refrigerant discharged from the compressor 10 to flow into the second heat-source-side heat exchanger 13*b*, the first opening and closing device 31 is closed, the second opening and closing device 32 is opened, the third opening and closing device 33 is closed, the fourth opening and closing device 34 is opened, and the fifth opening and closing device 35 is closed.

In the above configuration, in the case where the second heat-source-side heat exchanger 13*b* and the third heat-source-side heat exchanger 13*c* are used as condensers, the second series refrigerant passage is provided in which on the upstream side, the second heat-source-side heat exchanger 13*b* is located, and on the downstream side, the third heat-source-side heat exchanger 13*c* is connected in series to the second heat-source-side heat exchanger 13*b*.

According to embodiment 1, the single refrigerant passage is provided such that the first four-way valve 11 is made to block flowing of the refrigerant discharged from the compressor 10, the second four-way valve 12 is made to allow the refrigerant discharged from the compressor 10 to flow into the second heat-source-side heat exchanger 13*b*, the first opening and closing device 31 is closed, the second opening and closing device 32 is closed, the third opening and closing device 33 is opened, the fourth opening and closing device 34 is closed, and the fifth opening and closing device 35 is closed.

In the above configuration, in the case where the second heat-source-side heat exchanger 13*b* is used as a condenser, the single refrigerant passage using only the second heat-source-side heat exchanger 13*b* can be provided.

According to embodiment 1, the first heat-source-side heat exchanger 13*a*, the second heat-source-side heat exchanger 13*b* and the third heat-source-side heat exchanger 13*c* are formed such that the heat transfer area corresponding to the sum of the heat transfer area of the first heat-source-side heat exchanger 13*a* and the heat transfer area of the second heat-source-side heat exchanger 13*b* is larger than the heat transfer area of the third heat-source-side heat exchanger 13*c*.

In the above configuration, in the first series refrigerant passage, only the third heat-source-side heat exchanger 13*c* is provided on the downstream side of the evaporator, and the capacity on the downstream side of the evaporator is thus small. Therefore, even if the flow velocity of the refrigerant is slow, it is possible to reduce occurrence of refrigerant accumulation in which the refrigerant accumulates as liquid refrigerant on the downstream side of the evaporator, and thus to favorably circulate the refrigerant.

According to embodiment 1, the first heat-source-side heat exchanger 13*a* is provided independently. Part of the second heat-source-side heat exchanger 13*b* is formed integrally with the third heat-source-side heat exchanger 13*c*, sharing fins as heat-exchanger structural elements with the third heat-source-side heat exchanger 13*c*. The remaining part of the second heat-source-side heat exchanger 13*b*, which is other than the above part of the second heat-source-side heat exchanger 13*b*, is formed independently of the third heat-source-side heat exchanger 13*c*.

In the above configuration, as compared with a configuration in which an independent first heat-source-side heat exchanger 13*a* also shares fins with anther heat-source-side exchanger, the total numbers of headers and distributors included in the first heat-source-side heat exchanger 13*a*, the second heat-source-side heat exchanger 13*b* and the third heat-source-side heat exchanger 13*c* are reduced, thereby simplifying connecting pipes which are the refrigerant pipes 3, and reducing the size of the air-conditioning apparatus 100.

According to embodiment 1, in the first heat-source-side heat exchanger 13*a*, the second heat-source-side heat exchanger 13*b* and the third heat-source-side heat exchanger 13*c*, the heat transfer pipes, which are heat-exchanger structural elements, are flat pipes.

In the above configuration, each of the heat transfer pipes is formed to have a flat section, and it is therefore possible to increase the area of contact between the outdoor air and the heat transfer pipes, without increasing the ventilation resistance. Therefore, a sufficient heat exchange performance is obtained even if the first heat-source-side heat exchanger 13*a*, the second heat-source-side heat exchanger 13*b* and the third heat-source-side heat exchanger 13*c* are made smaller.

Although the above description is made by referring to by way of an example the case where a low-pressure, shell compressor is used as the compressor 10 of embodiment 1, the same advantages as stated above can be obtained even if for example, a high-pressure, shell compressor is used as the compressor 10.

Furthermore, although the above description is made by referring to by way of example the case of using a compressor not having a structure which allows the refrigerant to flow into an intermediate-pressure part of the compressor 10. The present invention, however, is also applicable to a compressor having an injection port which allows the refrigerant to flow into the intermediate-pressure part of the compressor.

In addition, in general, each of a heat-source-side heat exchanger and a load-side heat exchanger is provided with an air-sending device such as a fan, which sends air to the heat exchanger to promote condensation or evaporation of refrigerant. However, the present invention is not limited to such a configuration. For example, a device such as a panel heater utilizing radiation can be used as a unit for improving the heat exchange performance of the load-side heat exchanger. Furthermore, a water-cooled type of heat exchanger which causes heat exchange to be performed using liquid such as water or antifreeze can be used as the heat-source-side heat exchanger. Any type of heat exchanger can be used as long as it can cause the refrigerant to transfer or receive heat. In the case where a water-cooled type of heat exchanger is used, for example, a water-refrigerant heat exchanger, such as a plate heat exchanger or a double-pipe heat exchanger, may be installed and used.

REFERENCE SIGNS LIST

1 outdoor unit 2 indoor unit 3 refrigerant pipe 4*a* first main pipe 4*b* second main pipe 5*a* first primary pipe 5*b* second primary pipe 6 series pipe 7*a* first inlet and outlet pipe 7*b* second inlet and outlet pipe 8*a* first parallel pipe 8*b* second parallel pipe 9 third parallel pipe 10 compressor 11 first four-way valve 12 second four-way valve 13*a* first heat-source-side heat exchanger 13*b* second heat-source-side heat exchanger 13*c* third heat-source-side heat exchanger 14*a* first header 14*b* second header 14*c* third header 15*a* first distributor 15*b* second distributor 15*c* third distributor 16 fan 21 load-side heat exchanger 22 load-side expansion device 31 first opening and closing device second opening and closing device 33 third opening and closing device 34 fourth opening and closing device 35 fifth opening and closing device 41 pressure sensor 42 outdoor air temperature sensor 60 controller 100 air-conditioning apparatus

The invention claimed is:

1. An air-conditioning apparatus comprising:

a main circuit in which a compressor, a refrigerant-flow switching device, a load-side heat exchanger, a load-side expansion device, and at least three heat-source-side heat exchangers are connected by pipes to circulate refrigerant, the at least three heat-source-side heat exchangers including a first heat-source-side heat exchanger, a second heat-source-side heat exchanger and a third heat-source-side heat exchanger; and a heat-exchanger flow-passage switching device configured to switch a refrigerant passage to be used, between a first series refrigerant passage and a parallel refrigerant passage in accordance with whether the at least three heat-source-side heat exchangers are used as condensers or evaporators, the heat-exchanger flow-passage switching device being configured to switch the refrigerant passage to be used, to the first series refrigerant passage, in a case where the at least three heat-source-side heat exchangers are used as condensers, the first series refrigerant passage being provided as a refrigerant passage in which on an upstream side, the first heat-source-side heat exchanger and the second heat-source-side heat exchanger are connected parallel to each other, and on a downstream side, the third heat-source-side heat exchanger is connected in series to the first heat-source-side heat exchanger and the second heat-source-side heat exchanger, the heat-exchanger flow-passage switching device being configured to switch the refrigerant passage to be used, to the parallel refrigerant passage, in a case where the at least three heat-source-side heat exchangers are used as the evaporators, the parallel refrigerant passage being provided as a refrigerant passage in which the first heat-source-side heat exchanger, the second heat-source-side heat exchanger and the third heat-source-side heat exchanger are connected parallel to each other, the refrigerant-flow switching device including a first four-way valve configured to allow or block flowing of the refrigerant discharged from the compressor to the first heat-source-side heat exchanger, and a second four-way valve configured to allow the refrigerant discharged from the compressor to flow to the second heat-source-side heat exchanger or the load-side heat exchanger, the first series refrigerant passage being provided as a refrigerant passage in which the first four-way valve is made to allow the refrigerant discharged from the compressor to flow to the first heat-source-side heat exchanger, and the second four-way valve is made to allow the refrigerant discharged from the compressor to flow to the second heat-source-side heat exchanger, the parallel refrigerant passage being provided as a refrigerant passage in which the first four-way valve is made to block flowing of the refrigerant discharged from the compressor, and the second four-way valve is made to allow the refrigerant discharged from the compressor to flow to the load-side heat exchanger.

2. The air-conditioning apparatus of claim 1, wherein at least one of the at least three heat-source-side heat exchangers is provided with a single header and a single distributor.

3. The air-conditioning apparatus of claim 1, wherein each of the at least three heat-source-side heat exchangers is provided with a single header and a single distributor.

4. The air-conditioning apparatus of claim 1, wherein the heat-exchanger flow-passage switching device is configured to switch the refrigerant passage to be used, to the first series refrigerant passage, in a case where a cooling load on the load-side heat exchanger is higher than or equal to a first reference load, and the at least three heat-source-side heat exchangers are used as the condensers, and the heat-exchanger flow-passage switching device is configured to switch the refrigerant passage to be used, to a second series refrigerant passage, in a case where the cooling load on the load-side heat exchanger is lower than the first reference load and higher than or equal to a second reference load, and two of the at least three heat-source-side heat exchangers are used as condensers, the second series refrigerant passage being provided as a refrigerant passage in which on the upstream side, the second heat-source-side heat exchanger is located, and on the downstream side, the third heat-source-side heat exchanger is connected in series to the second heat-source-side heat exchanger.

5. The air-conditioning apparatus of claim 4, wherein the heat-exchanger flow-passage switching device is configured to switch the refrigerant passage to be used, to a single refrigerant passage in which only the second heat-source-side heat exchanger is used, in a case where the cooling load on the load-side heat exchanger is lower than the second reference load, and one of the at least three heat-source-side heat exchangers is used as a condenser.

6. The air-conditioning apparatus of claim 1, wherein the heat-exchanger flow-passage switching device includes a first opening and closing device provided at a first inlet and outlet pipe connected to part of a series pipe which is closer to the first heat-source-side heat exchanger, the series pipe connecting the first heat-source-side heat exchanger, the second heat-source-side heat exchanger and the third heat-source-side heat exchanger in series, the first opening and closing device being configured to allow or block passage of the refrigerant flowing through the first inlet and outlet pipe, a second opening and closing device provided at the series pipe, and configured to allow or block passage of the refrigerant flowing through the series pipe, a third opening and closing device provided at a first parallel pipe connecting a connection part at which the first inlet and outlet pipe and the series pipe are connected to each other and a main pipe extending to the load-side expansion device, the third opening and closing device being configured to allow or block passage of the refrigerant flowing through the first parallel pipe, a fourth opening and closing device provided at a second parallel pipe connected to part of the main pipe which is closer to the third heat-source-side heat exchanger, the fourth opening and closing device being configured to allow or block passage of the refrigerant flowing through the second parallel pipe, and a fifth opening and closing device provided at a third parallel pipe connecting the second four-way valve and the third heat-source-side heat exchanger, the fifth opening and closing device being configured to allow or block passage of the refrigerant flowing through the third parallel pipe, wherein in the first series refrigerant passage, the first four-way valve is made to allow the refrigerant discharged from the compressor to flow to the first heat-source-side heat exchanger, the second four-way valve is made to allow the refrigerant discharged from the compressor to flow to the second heat-source-side heat exchanger, the first opening and closing device is opened, the second opening and closing device is opened, the third opening and closing device is closed, the fourth opening and closing device is opened, and the fifth opening and closing device is closed, and wherein in the parallel refrigerant passage, the first four-way valve is made to block flowing of the refrigerant discharged from the compressor, the second four-way valve is made to allow the refrigerant discharged from the compressor to flow to the load-side heat exchanger, the first opening and closing device is opened, the second opening and closing device is closed, the third opening and closing device is opened, the fourth opening and closing device is opened, and the fifth opening and closing device is opened.

7. The air-conditioning apparatus of claim 6, wherein each of the third opening and closing device and the fourth opening and closing device is an expansion device whose opening degree is changed to adjust a flow rate, and wherein in a case of providing the parallel refrigerant passage, in the heat-exchanger flow-passage switching device, the opening degree of the third opening and closing device and the opening degree of the fourth opening and closing device are changed to adjust a flow rate of refrigerant to be made to flow to the first heat-source-side heat exchanger, a flow rate of refrigerant to be made to flow to the second heat-source-side heat exchanger and a flow rate of refrigerant to be made to flow to the third heat-source-side heat exchanger.

8. The air-conditioning apparatus of claim 6, wherein the fifth opening and closing device is formed as a backflow preventing device configured to prevent, in the third parallel pipe, the refrigerant from flowing from a passage on an inlet side of the second heat-source-side heat exchanger to a passage on an inlet side of the third heat-source-side heat exchanger, in a case where the at least three heat-source-side heat exchangers are used as the condensers.

9. The air-conditioning apparatus of claim 6, wherein in the second series refrigerant passage, the first four-way valve is made to block flowing of the refrigerant discharged from the compressor, the second four-way valve is made to allow the refrigerant discharged from the compressor to flow to the second heat-source-side heat exchanger, the first opening and closing device is closed, the second opening and closing device is opened, the third opening and closing device is closed, the fourth opening and closing device is opened, and the fifth opening and closing device is closed.

10. The air-conditioning apparatus of claim 6, wherein in the single refrigerant passage, the first four-way valve is made to block flowing of the refrigerant discharged from the compressor, the second four-way valve is made to allow the refrigerant discharged from the compressor to flow to the second heat-source-side heat exchanger, the first opening and closing device is closed, the second opening and closing device is closed, the third opening and closing device is opened, the fourth opening and closing device is closed, and the fifth opening and closing device is closed.

11. The air-conditioning apparatus of claim 1, wherein a sum of a heat transfer area of the first heat-source-side heat exchanger and a heat transfer area of the second heat-source-side heat exchanger is larger than a heat transfer area of the third heat-source-side heat exchanger.

12. An air-conditioning apparatus comprising:

a main circuit in which a compressor, a refrigerant-flow switching device, a load-side heat exchanger, a load-side expansion device, and at least three heat-source-side heat exchangers are connected by pipes to circulate refrigerant, the at least three heat-source-side heat exchangers including a first heat-source-side heat exchanger, a second heat-source-side heat exchanger and a third heat-source-side heat exchanger; and a heat-exchanger flow-passage switching device configured to switch a refrigerant passage to be used, between a first series refrigerant passage and a parallel refrigerant passage in accordance with whether the at least three heat-source-side heat exchangers are used as condensers or evaporators, the heat-exchanger flow-passage switching device being configured to switch the refrigerant passage to be used, to the first series refrigerant passage, in a case where the at least three heat-source-side heat exchangers are used as condensers, the first series refrigerant passage being provided as a refrigerant passage in which on an upstream side, the first heat-source-side heat exchanger and the second heat-source-side heat exchanger are connected parallel to each other, and on a downstream side, the third heat-source-side heat exchanger is connected in series to the first heat-source-side heat exchanger and the second heat-source-side heat exchanger, the heat-exchanger flow-passage switching device being configured to switch the refrigerant passage to be used, to the parallel refrigerant passage, in a case where the at least three heat-source-side heat exchangers are used as the evaporators, the parallel refrigerant passage being provided as a refrigerant passage in which the first heat-source-side heat exchanger, the second heat-source-side heat exchanger and the third heat-source-side heat exchanger are connected parallel to each other, the first heat-source-side heat exchanger being provided independently, part of the second heat-source-side heat exchanger being formed integrally with the third heat-source-side heat exchanger to share fins with the third heat-source-side heat exchanger, the fins being provided as heat-exchanger structural elements, and a remaining part of the second heat-source-side heat exchanger, which is other than the part of the second heat-source-side heat exchanger, being formed independently of the third heat-source-side heat exchanger.

13. The air-conditioning apparatus of claim 1, wherein at least one of the at least three heat-source-side heat exchangers includes heat transfer pipes as heat-exchanger structural elements, which are flat pipes.

14. The air-conditioning apparatus of claim 12, wherein at least one of the at least three heat-source-side heat exchangers includes heat transfer pipes as heat-exchanger structural elements, which are flat pipes.

* * * * *